US005983499A

United States Patent [19]

Andrews

[11] Patent Number: 5,983,499

[45] **Date of Patent: *Nov. 16, 1999**

[54] CAVITY SHAVING DEVICE WITH CURVED RAZOR BLADE STRIP

[76] Inventor: Edward A. Andrews, 6835 Beach Rd., Troy, Mich. 48098

[ * ] Notice: This patent is subject to a terminal disclaimer.

[21] Appl. No.: 08/739,364

[22] Filed: Oct. 28, 1996

Related U.S. Application Data

[63] Continuation-in-part of application No. 08/473,473, Jun. 7, 1995, Pat. No. 5,568,688.

[51] Int. Cl.[6] ..... B26B 21/56

[52] U.S. Cl. ..... 30/29.5; 30/49; 30/82

[58] Field of Search ..... 30/49, 29.5, 41.5, 30/43.5, 43.6, 113.1, 27, 353, 356, 346.59, 346.61, 82

[56] References Cited

U.S. PATENT DOCUMENTS

| | | | |
|---|---|---|---|
| 22,348 | 9/1858 | Stagg | 30/27 |
| D. 118,833 | 2/1940 | Pierson | 30/49 |
| 184,271 | 11/1876 | Tarleton | 30/353 |
| 282,677 | 8/1883 | Small et al. | 30/356 |
| 294,362 | 3/1884 | Brock | 30/356 |
| 630,731 | 8/1899 | Newsome | 30/353 |
| 839,447 | 12/1906 | Arnold . | |
| 951,036 | 3/1910 | Waterman | 30/49 |
| 951,456 | 3/1910 | Saxton | 30/49 |
| 993,132 | 5/1911 | Warner . | |
| 1,044,906 | 11/1912 | Ohlsson . | |
| 1,229,824 | 6/1917 | Tewelow . | |
| 1,264,605 | 4/1918 | Bonham . | |
| 1,266,868 | 5/1918 | Sheehan . | |
| 1,370,099 | 3/1921 | Dunkley . | |
| 1,431,764 | 10/1922 | Steeples | 30/356 |
| 1,452,930 | 4/1923 | Polk | 30/356 |
| 1,517,600 | 12/1924 | Stock . | |
| 1,522,298 | 1/1925 | Goodrich . | |
| 1,667,596 | 4/1928 | Kapota | 30/356 |
| 1,698,111 | 1/1929 | Terrell | 30/356 |
| 1,792,415 | 2/1931 | Dean | 30/27 |
| 1,799,907 | 4/1931 | Kaufmann . | |
| 1,801,889 | 4/1931 | Ventimiglia . | |
| 1,821,825 | 9/1931 | Zumwalt | 30/27 |
| 1,973,631 | 9/1934 | Johnson . | |
| 1,974,568 | 9/1934 | Grotenhuis | 30/49 |
| 1,981,958 | 11/1934 | Koree | 30/49 |
| 2,028,022 | 1/1936 | Sieminski . | |
| 2,055,129 | 9/1936 | Hill et al. . | |

(List continued on next page.)

FOREIGN PATENT DOCUMENTS

| | | | |
|---|---|---|---|
| 512.012 | 3/1920 | France | 30/23.1 |
| 383162 | 10/1923 | Germany . | |
| 1685 | 12/1911 | United Kingdom | 30/20 |

*Primary Examiner*—Kenneth E. Peterson
*Assistant Examiner*—Gyounghyun Bae
*Attorney, Agent, or Firm*—Harness, Dickey & Pierce, P.L.C.

[57] ABSTRACT

A manually operated, finger-manipulatable non-electric hair trimming device for shaving nostril hair, ear hair or the like, includes a head structure sized to fit within a small body cavity, such as a person's nostril or ear cavity, which includes a flexible razor blade strip. The head structure has a base portion and a curved guard portion, which preferably has first and second ends which are attached to the base portion. A finger grip portion is connected to the base portion to allow precise manual manipulation of the hair trimming device. The head structure further has a thin, elongated narrow razor blade strip with a razor sharp first edge portion, which may be a serrated edge with razor-sharp notches such as V-slots or may be a conventional straight edge. Alternatively, two razor-sharp edges, one serrated and one straight, may be provided. The razor blade strip preferably has an inverted U-shape, made by flexing it to extend substantially along the curved guard portion of the head structure, which may serve as the blade strip platform. The guard may have fingers which extend beyond the razor's edge with blade-exposing recesses therebetween.

37 Claims, 13 Drawing Sheets

U.S. PATENT DOCUMENTS

| | | | |
|---|---|---|---|
| 2,074,020 | 3/1937 | Marholt . | |
| 2,089,486 | 8/1937 | Kuhn . | |
| 2,111,861 | 3/1938 | Knapp . | |
| 2,139,680 | 12/1938 | Heinrich . | |
| 2,191,073 | 2/1940 | Fishbein et al. . | |
| 2,235,326 | 3/1941 | Muros . | |
| 2,241,719 | 5/1941 | Hardin . | |
| 2,275,180 | 3/1942 | Holsclaw . | |
| 2,488,436 | 11/1949 | Santoro, Sr. . | |
| 2,544,479 | 3/1951 | Zengel | 30/27 |
| 2,547,376 | 4/1951 | Crawford . | |
| 2,686,965 | 8/1954 | Lipman . | |
| 2,746,147 | 5/1956 | Booth . | |
| 2,804,684 | 9/1957 | Talamonti . | |
| 3,284,894 | 11/1966 | Ryan . | |
| 3,299,507 | 1/1967 | Mistretta . | |
| 3,381,373 | 5/1968 | Brown . | |
| 3,574,936 | 4/1971 | Bullerman . | |
| 3,667,470 | 6/1972 | Rubin | 30/356 |
| 3,675,323 | 7/1972 | Braginetz . | |
| 3,731,379 | 5/1973 | Williams . | |
| 3,829,966 | 8/1974 | Owens . | |
| 4,037,322 | 7/1977 | Bresler . | |
| 4,162,574 | 7/1979 | Johnston . | |
| 4,170,821 | 10/1979 | Booth . | |
| 4,285,124 | 8/1981 | Diakonov . | |
| 4,430,794 | 2/1984 | Miller . | |
| 4,464,835 | 8/1984 | Bowman et al. . | |
| 4,573,266 | 3/1986 | Jacobson . | |
| 4,603,477 | 8/1986 | Francis . | |
| 4,735,605 | 4/1988 | Swartz . | |
| 4,976,030 | 12/1990 | Boyd . | |
| 4,980,974 | 1/1991 | Radcliffe . | |
| 5,012,576 | 5/1991 | Johannesson . | |
| 5,343,622 | 9/1994 | Andrews . | |
| 5,568,688 | 10/1996 | Andrews | 30/29.5 |
| 5,581,887 | 12/1996 | Woodring | 30/356 |
| 5,669,142 | 9/1997 | Beckers et al. | 30/356 |

FIG-23A
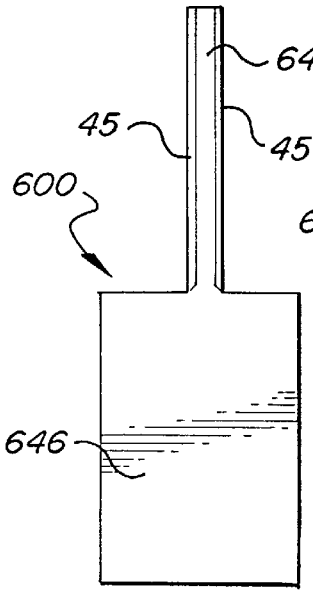
FIG-23B
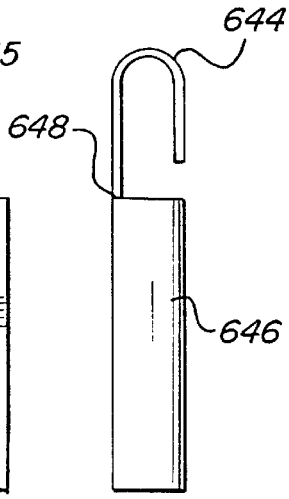
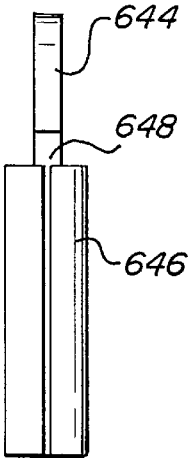
FIG-23C
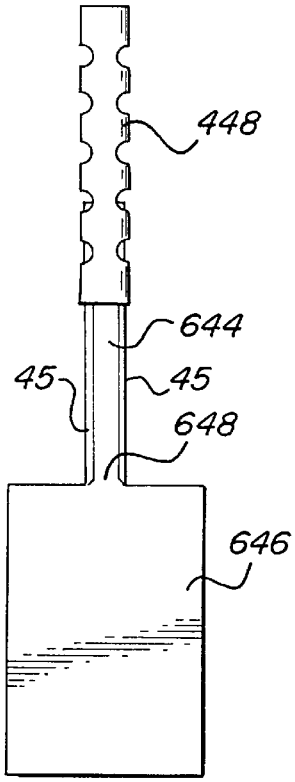
FIG-23D
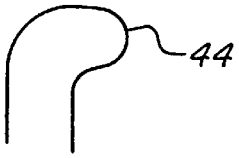
FIG-28
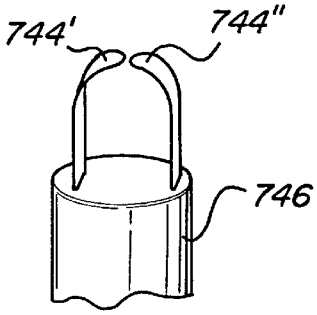
FIG-24
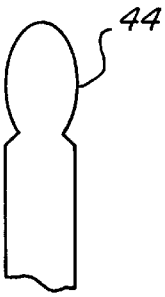
FIG-25
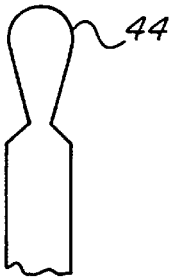
FIG-26
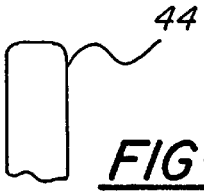
FIG-27

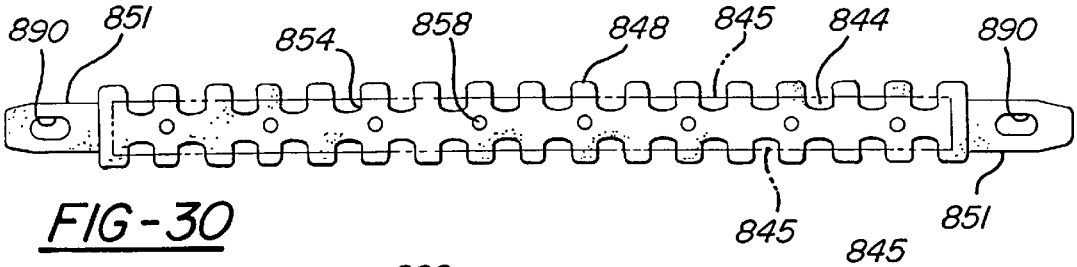
FIG-30
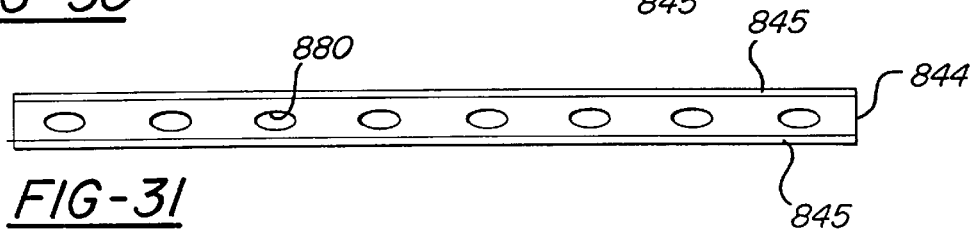
FIG-31
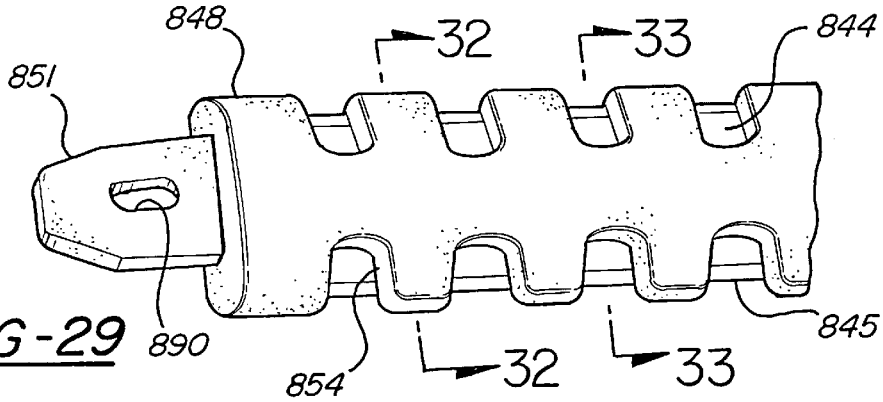
FIG-29
FIG-32
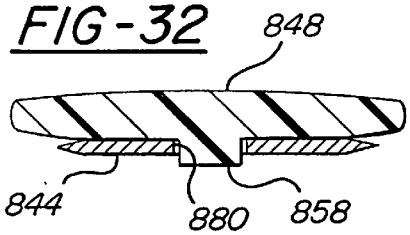
FIG-34
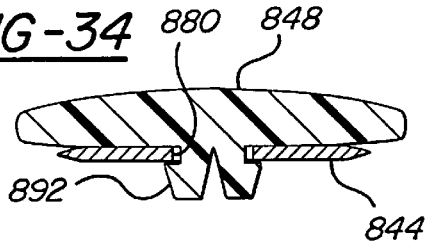
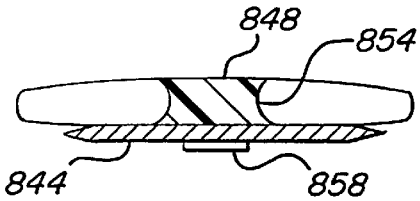
FIG-33
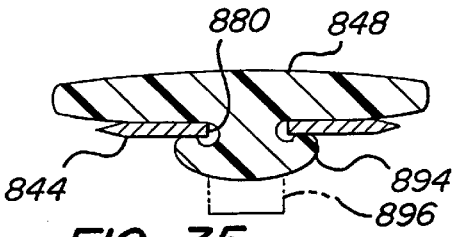
FIG-35

FIG-42
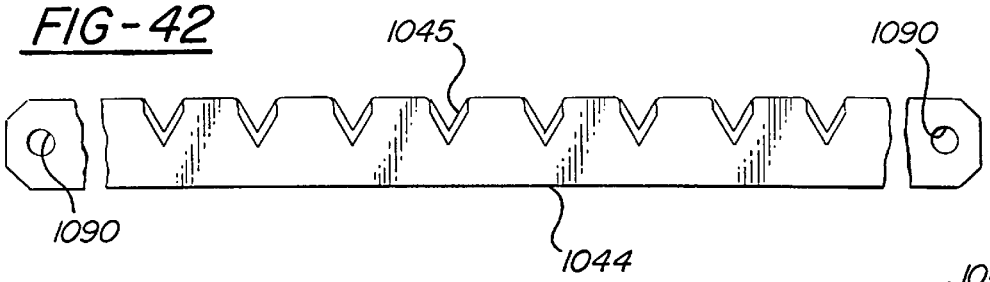
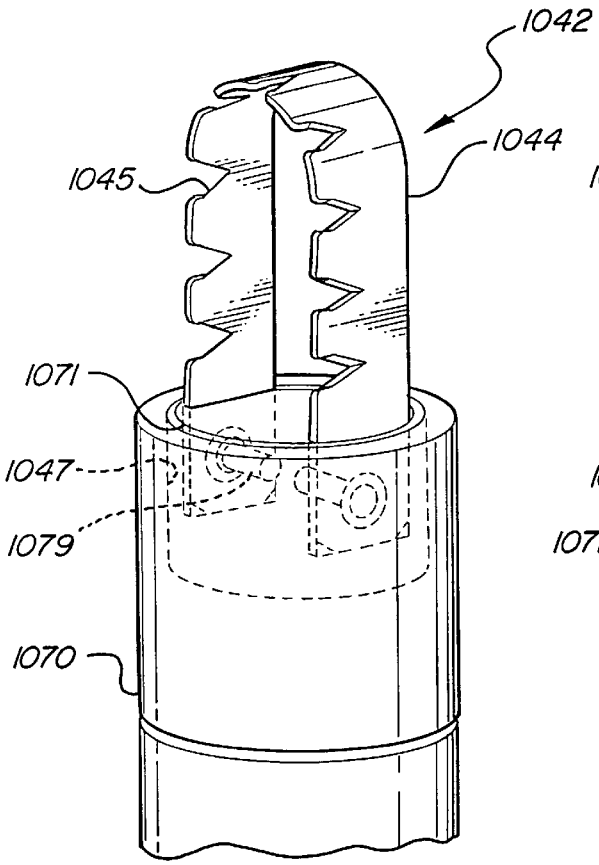
FIG-40
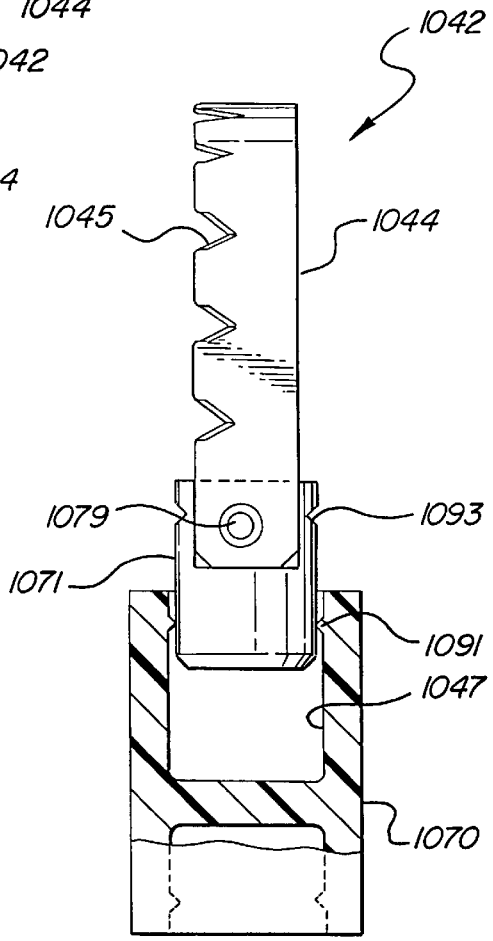
FIG-41
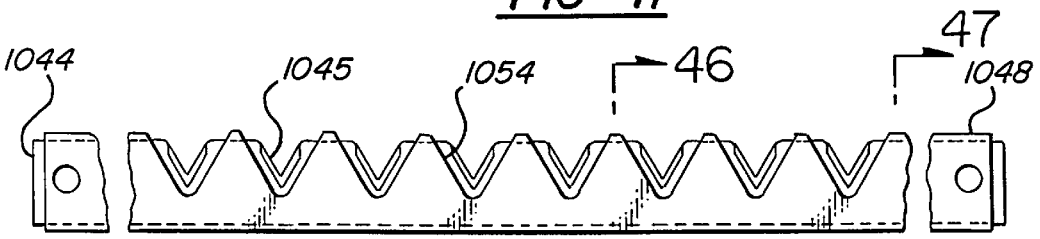
FIG-43

FIG-44
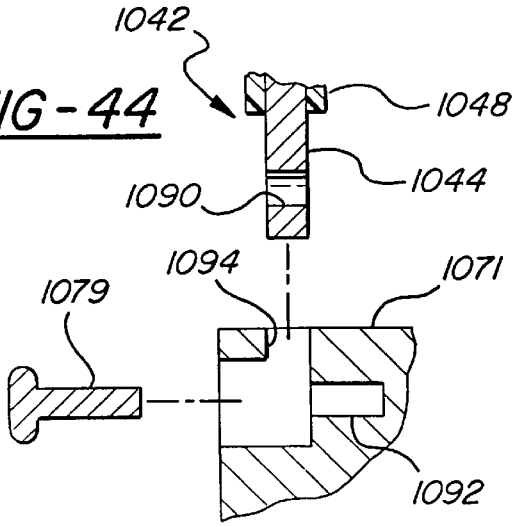
FIG-45
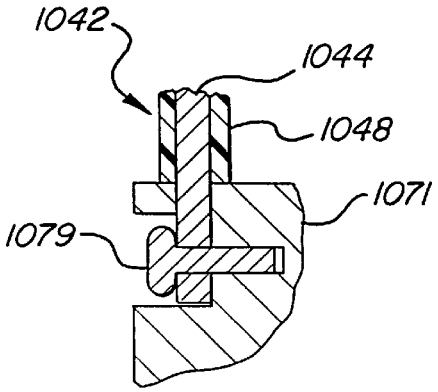
FIG-49
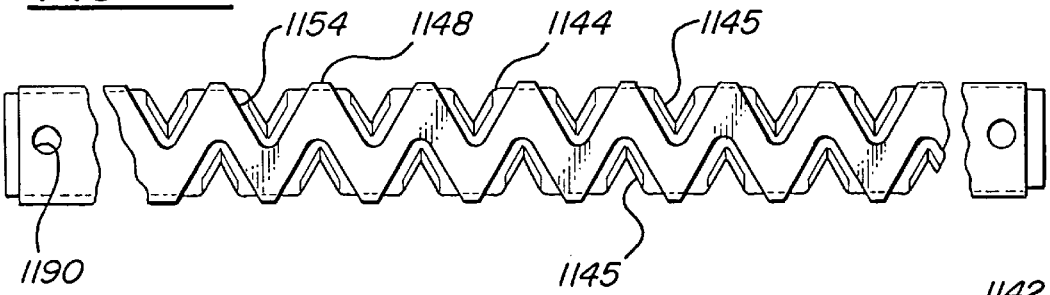
FIG-46
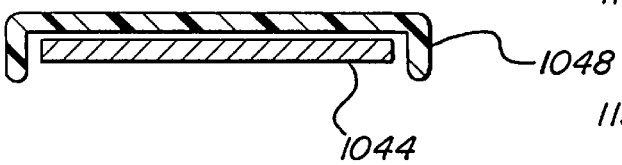
FIG-47
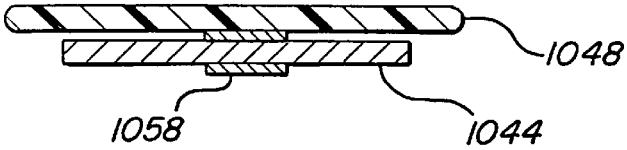
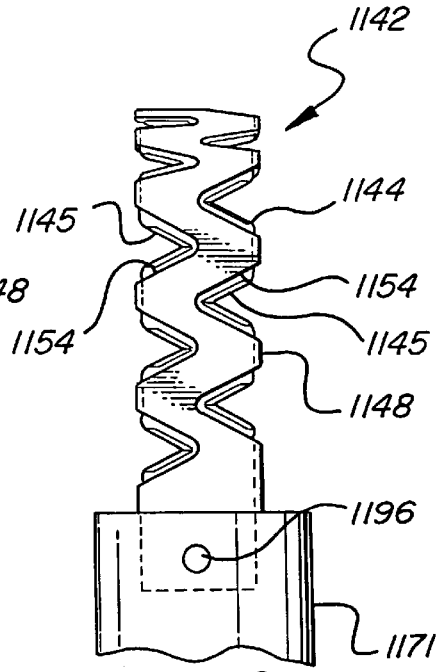
FIG-48

CAVITY SHAVING DEVICE WITH CURVED RAZOR BLADE STRIP

CROSS-REFERENCE TO RELATED APPLICATION

This application is a continuation-in-part of U.S. patent application Ser. No. 08/473,473 filed Jun. 7, 1995 and entitled "Hair Shaving Device With Curved Razor Blade Strip", which is to issue on Oct. 29, 1996 as U.S. Pat. No. 5,568,688.

FIELD OF THE INVENTION

This invention relates in general to curved razor blade strip structures for shaving hair and to manually-operated nose hair trimming devices, and in particular to small, lightweight manual hair trimming devices having one or more blade strips with curved razor-sharp cutting edge with a blade guard and/or platform adjacent thereto to permit safely and closely trimming hair, with a shaving action, particularly hair within the nostrils or ears.

BACKGROUND OF THE INVENTION

It is a common practice to trim the hair extending out of the nostrils or growing in the ears for aesthetic or health reasons. Many devices are used for this task. The devices range from small manicuring scissors or clippers, to specially made cutting devices or machines specifically designed for the task.

There are known devices for trimming nostril or ear hair which utilize a rotary blade to cut the hair. Examples of such devices are described in the following U.S. Pat. No. 4,162,574 to Johnston, U.S. Pat. No. 2,191,073 to Fishbein et al., U.S. Pat. No. 2,074,020 to Marholt, and U.S. Pat. No. 1,973,631 to Johnson. In these devices, a central rotary blade is disposed within a protective guard. The protective guard is provided with a series of slots for receiving hairs to be cut. The rotary blade is rotated manually to cut the hairs which are received in the slots in the protective guard. Other similar devices include a motor for driving the rotary blade within the protective guard. Examples of this type of motorized device are shown in U.S. Pat. No. 5,012,576 to Johannesson and U.S. Pat. No. 3,731,379 to Williams. The nostril hair trimming devices which utilize a rotary blade suffer from the disadvantages that the rotary blades are complicated and expensive to manufacture. The blades are not designed to be readily replaceable and sharpening the miniature blades is very difficult. If the blades become dull, proper cutting is not obtained, in which case nostril hairs can be pulled or yanked by the dull rotary blade causing discomfort and irritation to the user. In addition, the rotary blade type hair trimming devices can be unsanitary in that they are very difficult to clean. In such devices, the cut hairs are received and cut within the protective guards and there are no means for easily expelling the hairs from the devices after they have been cut.

Other known devices for trimming hair in the nostril utilize miniature clippers which include a stationary cutter member with a plurality of teeth and an adjacent reciprocating cutter member with a plurality of teeth. Hairs which enter the gaps between the teeth of the stationary cutter member are cut off when the adjacent reciprocating cutter member reciprocates past the stationary cutter member and the hairs are sheared. Examples of these known clipper devices are shown in U.S. Pat. No. 2,275,180 to Holsclaw and U.S. Pat. No. 2,055,129 to Hill et al. The clipper type hair trimming devices suffer from the disadvantage that the cutter members are expensive to manufacture and are difficult to maintain. In addition, the clippers can present the risk of cuts if the clippers are pressed against the skin of a user, since the skin can be pinched or cut by the reciprocating cutter member. Finally, clipper-type trimmers also can yank and pull the nostril hairs especially when the clipper edges become dull.

There are also known razor-type nostril hair trimming devices. Examples of razor-type hair trimming devices are shown in U.S. Pat. No. 1,229,824 to Tewelow, U.S. Pat. No. 3,574,936 to Bullerman, U.S. Pat. No. 2,139,680 to Heinrich, and U.S. Pat. No. 2,089,486 to Kuhn. The devices disclosed in the aforementioned patents to Tewelow and to Bullerman utilize straight razor blades having a guard along the sharpened edges. The straight razor blades are scraped along the inner wall of the nostril in order to shave off the hair. The razor-type hair trimming devices with a straight blade suffer from the disadvantages that they are believed ineffective in easily cutting hairs from the different curved nostril inner surfaces, from which many hairs extend.

The miniature razor trimming device disclosed in U.S. Pat. No. 2,139,680 to Heinrich utilizes a flat blade having a curved sharpened edge. The blade is angularly mounted on the end of a miniature head. A guard is provided for protecting the user from the sharpened edge of the blade. The miniature razor however suffers from the disadvantage that the blades which require a semicircular sharpened edge are difficult to manufacture.

The nasal razor disclosed in U.S. Pat. No. 2,089,486 to Kuhn uses a very short stiff curved steel razor blade positioned between a pair of hinged supports which are mounted to a handle. This nasal trimming device appears to suffer from the disadvantage that its rigid curved blade is useful only when used in a side scraping fashion. The nasal razor is quite small, and by necessity, the miniature blade is also very small, and therefore appears difficult to manufacture and handle. In addition, the blade is not provided with a long straight edge which is desirable for trimming hairs in certain parts of the nostril.

Thus, there has been a continuing need for some simple, inexpensive, lightweight device for enabling an individual to easily trim the nostril hairs without fear of any accidental cuts or scrapes within the nose. Such a hair trimming device for nostril hair should be capable of safely and effectively trimming hair from both curved and straight surfaces.

Further, there is a need for a nostril hair trimming device which has an easily-detached, disposable cutting head or deck, with a substantially permanent reusable handle or fingergrip support structure. There is also a need for a nose hair trimming device that is so small, compact and lightweight that it can fit in a very small size travel toiletry kit or manicuring kit, and can be easily carried around virtually undetected in one's pocket or purse.

The principal object of the present invention is to provide a small, simple-to-operate manual nose hair trimmer with a long curved razor-sharp blade strip which satisfies most if not all of the foregoing needs. An additional object is to also provide such a device which is extremely reliable and safe to use, and which does not require electric power.

A further object is to provide such a nose trimmer with a small grip portion that may be gripped solely in the user's fingertips, for maximum maneuverability. In this way, the user will be able deftly to cut nostril hairs even in the difficult to reach frontal cavity or pocket of each nostril. One more object is to provide an effective cutter head portion which is so small that it can be comfortably inserted into and moved around within a nostril.

One more object is to provide a curved blade hair shaving device which is sufficiently inexpensive so that it may be discarded and replaced frequently. Another object is to provide a nose hair trimming device that does not use a scissors action, and does not have any internal moving parts to break or bind up. One more object is to provide a nostril hair trimming instrument that never pulls or yanks out nostril hairs.

Still another object of the present invention is to provide a cutter portion on a hair shaving device which employs a curved razor blade end-cutting geometry, so that the topmost part of the cutter section of the device can cut hair by a shaving action as well as the side blade strip portion of the cutter section, by using a single sharpened razor blade strip bent into a curved loop configuration.

Another object of the present invention is to use a thin elongated strip of stainless steel provided with a razor-sharp edge that can be mass-produced with ease as the operative tool that is used to shave or cut hair, especially nostril hair. A related important object of the invention is to curve or bend the razor-blade strip into a loop or U-shape to provide the desired end cutting and side-cutting geometry from a single elongated strip of metal alloy having at least one razor sharp edge. A further related object is to provide a cutter head structure that employs a curved elongated razor blade strip within a guard structure that can be easily cleaned to facilitate its reuse.

Yet another object is to provide an easily cleaned curved loop razor blade structure, to facilitate reuse of the curved blade shaving device, which may be a nose hair trimmer, as long as the blade edge remains sufficiently sharp.

Another object is to provide a guarded curved blade shaving device, such as nose hair trimming device, which is inherently easy to operate, so that with a minimum of practice, a user need not even look in a mirror as he uses the device to shave his nostrils or other curved body portions with the device, i.e., those cavities which the end cutting bent loop shape can reach.

Another object of this invention is to provide a razor-sharp nose hair trimmer device which has a manually removable and replaceable, plastic cover which fits over the cutter head for encasing the sharp edge, and is frictionally held in place on the handle, so that it can be stored and transported safely.

SUMMARY OF THE INVENTION

In order to fulfill the most if not all of the needs and objects above-stated, there is provided according to a first few embodiments of the present invention, a manually operated, finger manipulatable non-electric nose hair trimming device, comprising: a head structure sized to fit within a person's nose cavity and arranged to support a flexible razor blade strip having a base portion and a curved guard portion extending from said base portion, said curved guard portion having first and second ends which are attached to said base portion; and a finger grip portion having an end connected to the base portion of said head structure, wherein said head structure includes a thin, elongated narrow razor blade strip formed from a strip of flexible flat razor blade material and bent in a central section thereof to provide a substantially semi-circular section disposed in between first and second substantially straight sections on either side thereof that terminate respectively at first and second ends, said razor blade strip being arranged to extend substantially along the curved guard portion of the head and having a sharpened first edge disposed between the first and second ends, the first and second ends being attached at spaced locations to said base portion of said razor head.

In accordance with another embodiment of the present invention, a manually operated, non-electric nose hair trimming device is provided that has a finger grip portion and a head structure having a base portion in connection with the finger grip portion. The head structure is provided with a hook-shaped blade having first and second ends and at least one razor sharp edge disposed therebetween. The hook-shaped blade is attached to the base portion at the first end, and extends generally perpendicularly away from the base portion and curves around back toward the base portion, but the second end of the hook-shaped blade remains spaced from the base portion.

In accordance with yet another embodiment of the present invention, a hair trimming razor head structure is provided for trimming nose hair or ear hair which includes a very thin elongated razor blade strip with at least one substantially curved razor-sharp edge for shaving hair within a nose or ear cavity, for attachment to a handle of a hair trimming device. The razor head structure includes a base portion with means for connecting the base portion to the handle and a single thin ribbon-like blade strip having two parallel opposed flat surfaces with a first end and a second end and at least one razor sharp edge disposed between the first and second ends. The blade strip is bent to form a curved blade strip that is generally U-shaped and fits within a nose or ear cavity, and which is attached to the base portion at the first end from which the curved blade strip extends away from the base portion and curves around and is attached again to the base portion at the second end of the curved blade strip.

In accordance with still another embodiment of the present invention, a manually operated, finger-manipulatable non-electric hair trimming device is provided for shaving nostril hair, ear hair or the like. The hair trimming device includes a head structure sized to fit within a small body cavity and arranged to support a flexible razor blade strip. The head structure includes a base portion and a curved guard portion extending from the base portion. The curved guard portion has first and second ends which are attached to the base portions. A finger grip portion is provided having an end connected to the base portion of the head structure, for manually manipulating the hair trimming device. The head structure further has a thin, elongated narrow razor blade strip provided with a razor sharp first edge portion, the razor blade strip being bent to extend substantially along the curved guard portion of the head structure such that the sharpened first edge portion defines a curved end cutting edge for trimming hair within a body cavity.

Other objects, features, operating principles, and advantages of the nose hair trimming devices of the present invention will become apparent upon studying the various Figures in the drawings and reading the following detailed description and subjoined claims.

BRIEF DESCRIPTION OF THE DRAWINGS

In the drawings, where the same reference numerals reference like items or features in the different views:

FIGS. 13A through 13E show enlarged views of a series of elongated thin flexible flat metal alloy razor blade strips with one or more razor-sharp edge portions usable in the various embodiments of the present invention wherein:

FIG. 13A is an elongated razor blade strip having a single sharpened edge and a series of centered slots through which the interlock pins of the cage guard extend;

FIG. 13B is a second razor blade strip having end portions which have rectangular apertures to permit preassembly of the blade onto a correspondingly-shaped protrusion of a blade support platform or base structure or a cage guard;

FIG. 13C shows a third razor blade strip having only one side sharpened in three separate places with unsharpened segments therebetween;

FIG. 13D shows a fourth blade strip with a single sharpened edge, to be used in my hair shaving devices to provide end-cutting only; and FIG. 13E is a fourth blade strip having a plurality of notches to permit the blade segments therebetween to be flexed or be twisted.

FIG. 17 is a perspective view of the tenth embodiment with the base portion only partly shown;

FIG. 18 shows a plan view of the sheath before folding overlaid upon a phantom view of the sharpened razor blade;

FIG. 19 shows an end cross-sectional view taken along lines 19—19 of FIG. 17, further showing how the sheath is wrapped around the blade strip; and FIG. 20 is a top cross-sectional view taken along lines 20—20 of FIG. 17, showing two concentric metal rings snapped together which hold the ends of the metal blade and blade edge guard sheath in place.

FIGS. 23A–23D illustrate a twelfth embodiment of the nose hair trimmer of the present invention, including a U-shaped hook blade connected at only one end to the base portion;

FIG. 24 is a perspective view of a thirteenth embodiment of the present invention, which includes a plurality of blade strip portions symmetrically arranged about an oval base support structure; and FIGS. 25–28 show alternative shapes that can be utilized for the bend in the blade strip.

FIGS. 29 through 33 show a fourteenth embodiment of the noise hair trimming device of the present invention, which features a flexible polymeric serrated guard member overlying a flexible razor blade strip having registration holes punched therein, where:

FIG. 29 shows a fragmentary view of the guard member with the razor blade strip assembled thereto, FIGS. 30 and 31 show plan views of the guard member and razor blade strip respectively, and FIGS. 32 and 33 show a transverse cross-sectional view taken along lines 32—32 and 33—33 of FIG. 29.

FIGS. 34 and 35 illustrate two different methods of permanently attaching the FIG. 30 guard member to the FIG. 31 razor blade strip.

FIGS. 36 and 37 are front and side elevational views of the assembled head structure of the fifteenth embodiment which can be affixed to any suitable fingergrip portion, and FIG. 38 is an exploded side elevational view of the three major elements of the fifteenth embodiment.

FIGS. 40 through 42 illustrate an sixteenth embodiment of the hair trimming device of the present invention, which features a removable head structure cartridge with a serrated razor blade strip with razor sharp V-notch serrations, where:

FIG. 40 is a perspective front view of the device with the removable cylindrical base connection portion of the head structure shown hidden lines within a cylindrical bore of a fingergrip base, and FIG. 41 is a side elevational view in partial cross-section of the FIG. 40 device, and FIG. 42 is a fragmentary plan view of the serrated thin elongated flexible razor blade strip.

FIG. 43 is a second version of the serrated flexible razor blade strip having a serrated flexible guard member positioned on one side of the razor blade strip with its V-notches in registration with the V-notches of the underlying razor blade strip.

FIGS. 44 and 45 illustrate how the FIG. 43 razor strip with guard may be received at either end by the base portion of the removable head structure, and affixed thereto with a fastener such as a pin as shown.

FIGS. 46 and 47 are transverse cross-sectional views taken along lines 46—46 and 47—47 respectively of FIG. 43.

FIGS. 48 and 49 illustrate a seventeenth embodiment of my hair trimming device which has a serrated razor blade strip with dual serrated edges and a guard member having dual serrated edges in registration with the serrations on the blade strip, with FIG. 48 being a side elevational view thereof, and FIG. 49 being a fragmentary plan view of the razor blade strip and guard each having dual serrations.

FIG. 52 is a fragmentary perspective view of one end of the serrated blade strip and guard of the nineteenth embodiment, FIG. 53 is a plan view of the FIG. 52 blade strip and guard, showing the registration of the notches between blade strip, and FIGS. 54 and 55 are transverse cross-sectional views taken along lines 54—54 and 55—55 respectively of FIG. 53.

FIGS. 56 through 59 illustrate a twentieth embodiment of the present invention, which features a serrated blade construction formed from two preferably identical serrated razor blade strips, with:

FIG. 56 showing the two blade strips combined and in offset registration, so as to form razor-sharp V-notches as shown, which is ready to be bent into an inverted U-shape and secured to the base portion of the head structure of the device, and FIGS. 57 and 58 are plan views of the two razor blade strips that are shown combined in FIG. 56, and FIG. 59 is an greatly enlarged side view of one of the notches of the combined FIG. 56 blade strip illustrating the double-edged cutting action on a hair strand that is moving toward the bottom of the razor-sharp notch.

FIGS. 60 and 61 illustrate a twenty-first embodiment of the present invention of the hair trimming device of the present invention, which is achieved, like the fifteenth embodiment, by using two overlapping razor-sharp serrated blade strips, with:

FIG. 60 showing a fragmentary plan view of the two serrated blade strips in registration with one another and with a serrated blade guard having gently rounded fingers extending beyond the tips of the serrations, and FIG. 61 being an exploded perspective view of representative fragmentary sections of the two blade strips shown in FIG. 60.

DETAILED DESCRIPTION OF THE PREFERRED EMBODIMENTS

Several different hair trimming devices of the present invention which employ one or more curved razor-sharp blade strips are shown in the Figures and discussed herein. While these embodiments are presently preferred, they are still only exemplary of the various possible curved razor blade strip hair shaving structures and devices of the present invention. As explained further below, I contemplate that, within the scope of the present invention, variants of the curved blade shaving devices of my present invention may readily be constructed based upon my teachings herein.

Figure 1:
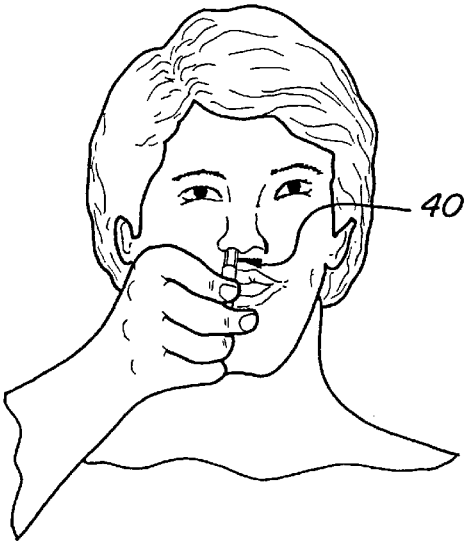
FIGS. 1 and 2 are a front view and an enlarged side perspective view respectively of a man using a first embodiment of the curved blade hair trimming device of the present invention, also shown in FIG. 3, to trim hair within his nose.
Figure 2:
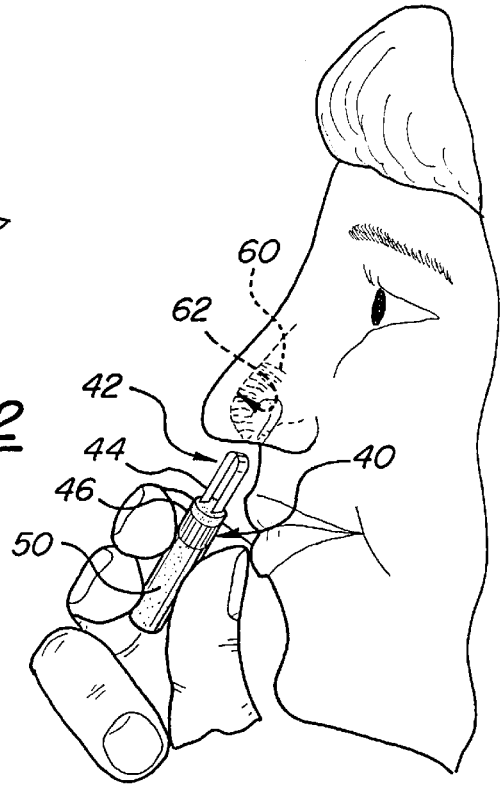

With reference to FIGS. 1 and 2, there are shown a front and a side perspective view of a man using a first embodiment of a basic hair shaving device of the present invention which has a U-shaped razor-sharp blade strip therein, for shaving his nostril hair. In FIG. 1, the nose hair trimming device 40 has a fingergrip sized grip portion, which is hidden by the user's hand. In FIG. 2, a finger-grip sized portion 50 can be seen and is connected to a head structure 42 which includes a curved blade 44 connected to a base portion 46. The nose hair trimming device 40 can be used to safely and effectively trim nostril hair 60 from both curved and straight surfaces within the user's nostril by the use of a straight, generally downwardly-directed shaving stroke. In addition, the curved end-cutting geometry allows the device to be used to cut nostril hairs 60 in the difficult to reach frontal cavity or pocket 62.

The fingergrip portion 50 of the nose hair trimming device 40 may be made of a molded plastic material or of a metal stamping or casting. The body of the device 40 is divided into a head portion 42 and an integral finger grip portion 50. The overall length of the device is relatively small, as for example, on the order of 1.5 to 3.5 inches long with the cutter end or head section being roughly ¾ inches long. In addition, the fingertip grip portion is preferably axially aligned with the head.

Figure 3:
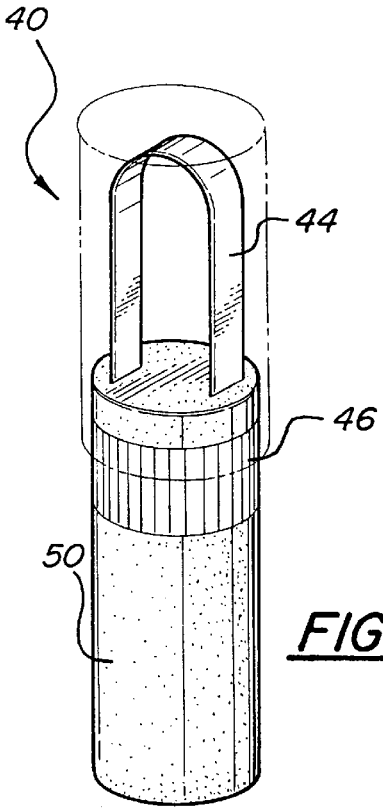
FIG. 3 is a side perspective view of the basic shape of the curved blade razor shaving device of the present invention, with its optional protective guard, and with a clear plastic cover shown in phantom, showing the inverted U-shape of its metal blade strip, having at least one full razor-sharp edge, embedded into the fingergrip base.

With reference to FIG. 3, a perspective view is shown of a basic trimmer 40 of the present invention without a protective guard. The basic geometry of the hair trimming device 40 includes a U-shaped metal blade strip 44 embedded into a base 46. The blade strip 44 when not in use is ribbon-like and is provided with two parallel opposed flat surfaces and a razor sharp edge. A cap member 47 is shown in phantom for covering the blade strip 44.

Figure 4:
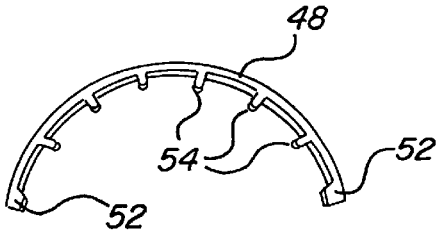
FIG. 4 is a perspective view of a first embodiment of the protective blade guard cage having multiple overhanging guard fingers, that is usable with the FIG. 3 embodiment.

FIG. 4 is a perspective view of a protective blade guard 48 usable with the device of FIG. 3. The protective blade guard 48 is provided with two end portions 52 for connecting the protective blade guard to the metal blade strip 44 or the base portion 46. The protective guard 48 is also provided with a plurality of teeth or fingers 54, spaced apart as shown which are designed to overhang portions of the sharpened edges on either side of the elongated blade strip 44. Depending upon the width and number of and spacing between the fingers 54, anywhere from about 20 percent to about 80 percent of the blade edge may be exposed through the spaces between the fingers 54, with 35 to 70 percent exposure being preferred. The fingers extend sufficiently beyond the sharpened edge of the adjacent blade, by about 0.5 mm to about 2 mm or more, depending upon the finger spacing, so that it is essentially impossible for the skin of the user to make a contact with the sharpened blade edge, even when above average side pressure is applied by the user to the cutter end of the device. In particular, when the spacing of the fingers 54 is sufficiently close, such as on the order of about 1 mm to about 2 mm, this result is easily accomplished. The width of the individual fingers 54 is preferably on the order of about 1 mm to about 4 mm, with 2 to 3 mm being presently preferred. The outer surfaces of the fingers 54 that do or potentially can come into contact with the user's skin are preferably gently rounded as shown to reduce the possibility of inadvertently scratching the user's skin. Such scratches might otherwise occur with sharp edges on the fingers as a user draws the fingers gently across his skin within his nostrils (or elsewhere) as he executes a generally linear and downwardly directed or laterally directed shaving stroke across the skin from which the nostril hairs to be trimmed protrude.

Figure 5:
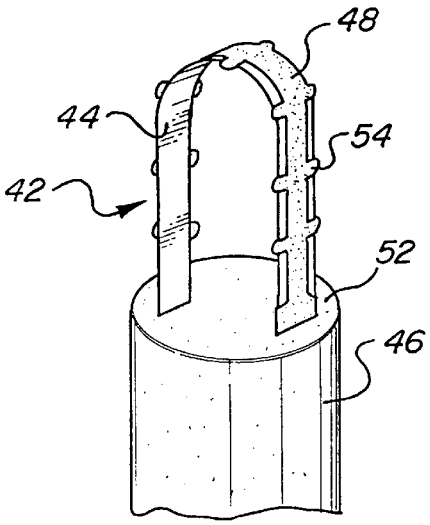
FIG. 5 is a perspective view of a second embodiment of the curved blade hair shaving device of the present invention, showing the FIG. 4 protective blade guard in place over the metal blade strip of the FIG. 3 device, and revealing how the fingers partially envelop the edge of the blade strip.

FIG. 5 is a perspective view showing a second embodiment of the present invention with the protective blade guard 48 in place over the metal blade strip 44 of the device shown in FIG. 3. The protective guard 48 can be secured to the metal blade strip 44 by any means including glue.

Figure 6A:
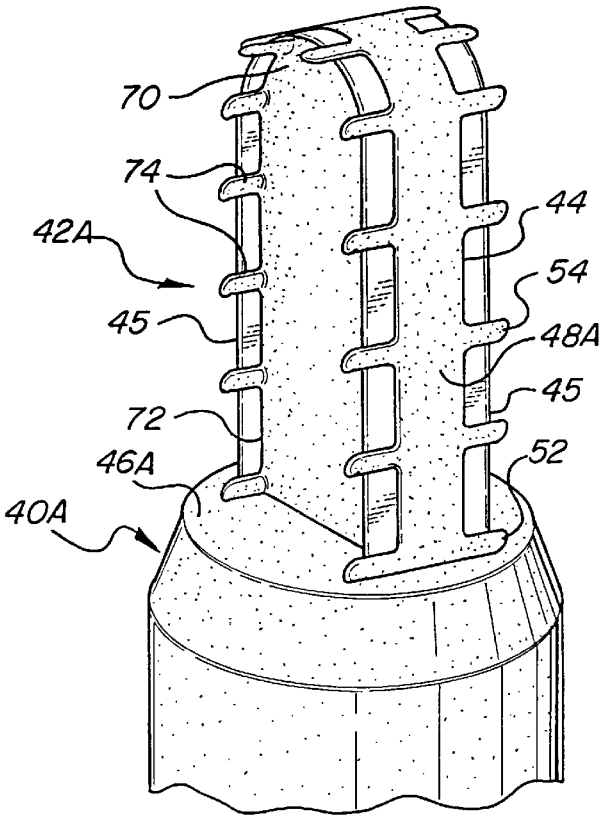
FIG. 6A is a perspective view of a cutter end portion of a third embodiment of the curved blade hair shaving device of the present invention, showing an elongated double-edged razor blade strip, an (inverted) U-shaped solid blade support platform inside the blade strip, and a multiple finger guard cage interlocked by pins (not shown), the blade strip extending through and into the support platform overlaying the sharpened blade edges for protecting the user's skin against blade nicks.

FIG. 6A is a perspective view of a third embodiment of the head structure 42A of the nose hair trimming device 40A of the present invention. In FIG. 6A there is shown a generally solid blade support platform 70 having a horseshoe-shape perimeter which is attached to a base portion 46A of the head structure 42. A double-edged blade strip 44 is wrapped around the horseshoe-shaped blade support platform 70 such that each of the razor-sharpened edges 45 of the double-edged blade strip 44 extend beyond outer edges of a blade seat portion 72 of the horseshoe-shaped blade support platform 70. A multiple finger guard cage 48A overlays the blade edges 45 for protecting against blade nicks. The multiple finger guard cage 48 secures the blade in its position along the blade seat portion 72 by means which will be described in greater detail hereinafter. The blade seat portion 72 of the blade support platform 70 is provided with a plurality of extending fingers 74 which correspond with the fingers 54 of the cage guard 48.

Figure 6B:
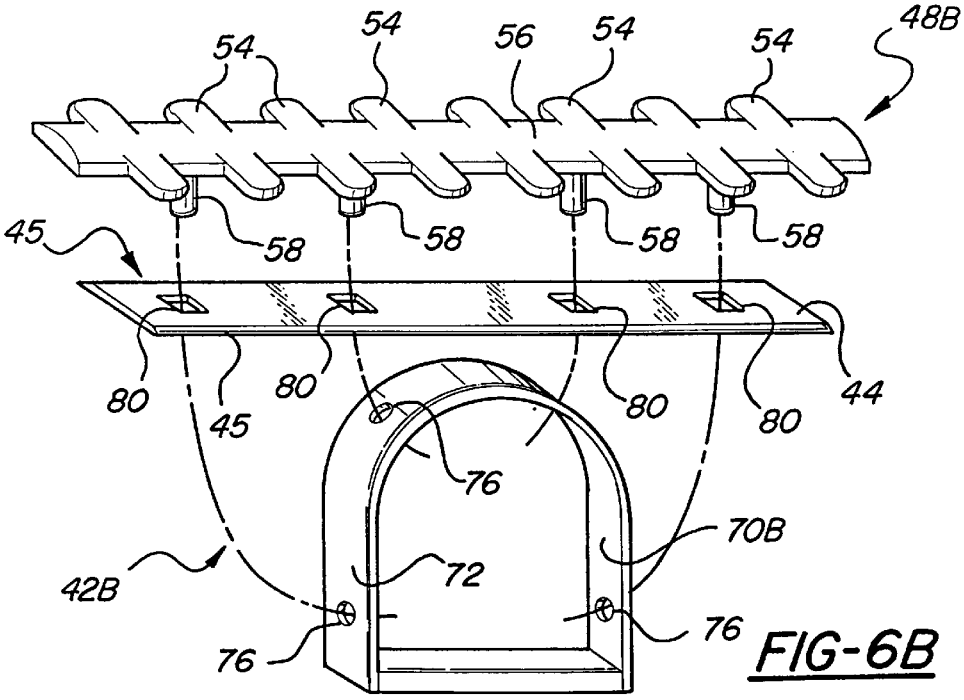
FIG. 6B is an exploded perspective view of the components of the cutter end portion of the fourth embodiment which is like the third embodiment of FIG. 6A, except the blade support platform (which is a hollow second version) of a nose hair trimming device of the present invention.

FIG. 6B is a perspective view of a fourth embodiment 42B of the present invention illustrating the assembly of a head structure 42B usable in the nose hair trimming device 40. In particular, a hollow horseshoe-shaped blade support platform 70B is provided having a plurality of pin receiving holes 76 disposed in the periphery of the horseshoe-shaped blade support platform 70B. A double-edged blade strip 44 is shown having a plurality of pin receiving holes 80 which correspond to the locations of the pin receiving holes 76 of the horseshoe-shaped blade support platform 70. The double-edged blade strip 44 is wrapped around the periphery of the blade seat portion 72 of the blade support platform 70. A multiple finger guard cage 48B is provided having an elongated central portion 56 with a plurality of protective fingers 54 extending laterally therefrom. In addition, a plurality of pins 58 extend from a bottom of the elongated central portion 56 thereof. In order to assemble the head structure 42 of the nose hair trimming device 40, the pins 58 of the multiple finger guard cage 48B are inserted through the pin receiving holes 80 in the double-edged blade strip 44 and both the multiple finger guard cage 48B and the double-edged blade strip 44 are wrapped around the periphery of the blade seat portion 72 of the blade support platform 70. The pins 58 are then inserted into the holes 76 provided in the periphery of the blade seat 72 in order to secure the blade strip 44 and the guard cage 48 to the blade support platform 70.

Figure 7A:
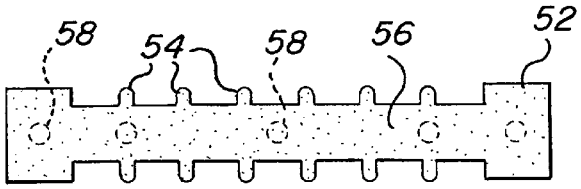
FIGS. 7A and 7B are top and side elevational views, respectively, of an alternate version of the guard cage usable within the two versions of the embodiments shown in FIGS. 6A and 6B, which guard cage has overhanging fingers that will partially envelop the edges of the blade strip.
Figure 7B:
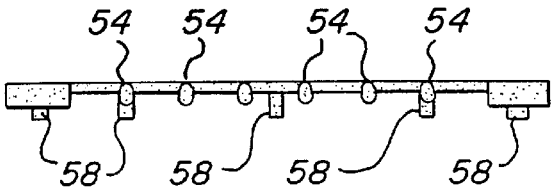

With reference to FIGS. 7A and 7B, the multiple finger guard cage 48B used in the fourth embodiment will be described in detail. The multiple finger guard cage 48B includes a central elongated strip 56 having two end connecting portions 52. A plurality of laterally extending fingers 54 extend from the first and second edges of the elongated central portion 56. As best seen in FIG. 7B, the lateral extending fingers 54 may be arranged to extend beyond a lower surface of the elongated central portion 56. A plurality of pins 58 are also provided which extend from the lower surface of the end connecting portions 52 and at intervals along the elongated central portion 56. The number of pins 58 can be varied according to specific design choices.

Figure 8:
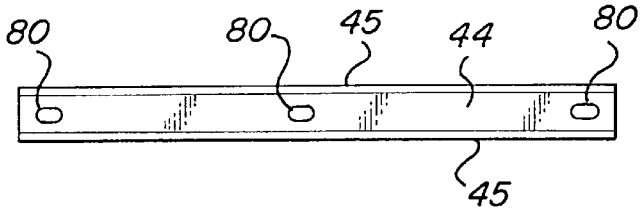
FIG. 8 is a plan view of a representative elongated thin blade strip for the fourth embodiment (FIG. 6) shown laid out in planar form, which reveals the opposed razor-sharp blade edges and a series of apertures through which the locking pins of the guard cage protrude.

With respect to FIG. 8, a double-edged blade strip 44 according to the fourth embodiment is shown in planar form. The blade strip 44 is provided with two razor-sharpened edges 45 and a plurality of elongated apertures 80 through which pins of the guard cage are inserted.

Figure 9:
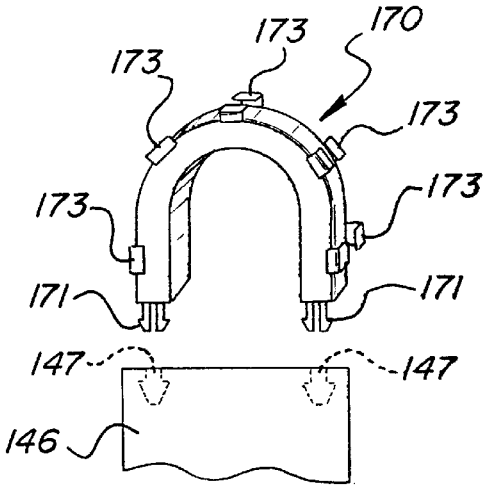
FIG. 9 is a side perspective view of a fifth embodiment of the present invention, which employs a third version of a U-shaped blade support platform, which has protruding side ears that are used in place of the guard cage shown in the second embodiment, and which also has nape-prongs at the lower free ends of the support platform that couple into corresponding apertures in the base portion.

FIG. 9 is a side view of a fifth embodiment of the nose hair trimmer of the present invention which employs a horseshoe-shaped blade support platform 170. The blade support platform 170 is provided with nape-prongs 171 at the lower ends of the blade support platform 170 which couple into and interlock with corresponding apertures 147 in the base portion 146. The blade support platform 170 is provided with protruding side ears 173 which take the place of the guard cage shown in the fourth embodiment. The protruding side ears 173 extend beyond the outer edges of a blade strip, not shown, and wrap around the outer edges of the blade strip in order to secure the blade strip to the blade support platform 170. As noted above, the protruding side ears 173 provide a guard for protecting against blade nicks.

Figure 10:
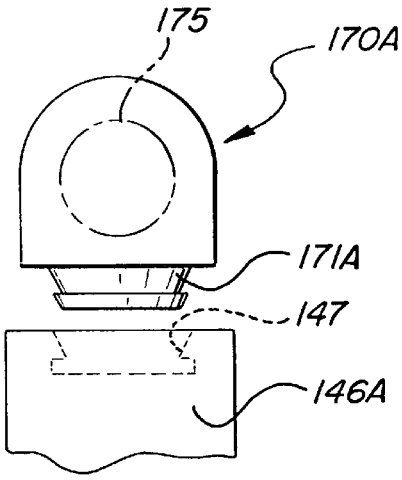
FIG. 10 is a side elevational view of a sixth embodiment of the present invention, which employs a fourth version of a U-shaped blade support platform with an oblong lower post with a lower protruding lip that snaps into a single corresponding internal hole with lower internal groove in the fingertip base.

With respect to FIG. 10, a sixth embodiment of the present invention is shown with a second version of the blade support platform 170A having a single prong 171A for insertion into and interlocking with a corresponding internal hole 147 of the fingergrip base 146A is shown. The blade support platform 170A may be provided with a centrally disposed hole 175 as shown in phantom lines.

Figure 11:
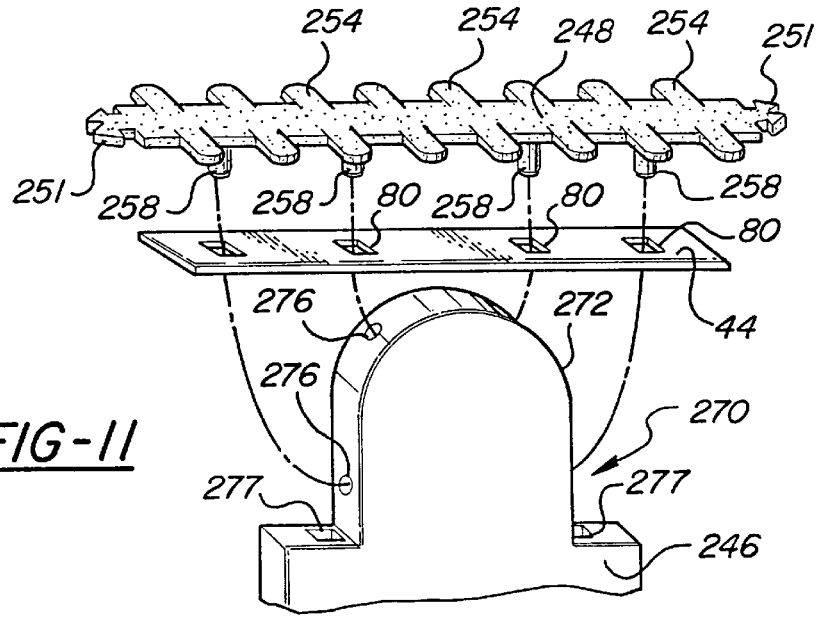
FIG. 11 is a side elevational view of a seventh embodiment, which employs a fifth version of my U-shaped blade support platform made from plastic material with an integral fingergrip base, showing the curved blade strip and cage guard ready to snap into registration holes in the integral platform and base.

As shown in FIG. 11, a seventh embodiment of the present invention is shown with a third version 270 of a blade support platform 170. The blade support platform 270 is provided with a base portion 246 and a U-shaped blade seat portion 272 integrally formed. The U-shaped blade seat portion 272 is provided with a plurality of holes 276 at various intervals around the periphery of the blade seat portion 272. A pair of receiving holes 277 are also provided in the base portion 246 adjacent to each side of the blade seat portion 272. A blade strip 44 and a multiple finger guard cage 248 are provided for being assembled onto the blade support platform 270. The guard cage 248 is provided with a plurality of pins 258 which are inserted in corresponding pin holes 80 in the blade strip 44 and also inserted into the pin holes 276 of the blade support platform 270. The multiple finger blade guard 248 is also provided with nape-prongs 251 on each end thereof which are inserted into and interlocking with the holes 277 in the base portion 246 of the blade support platform 270.

Figure 12:
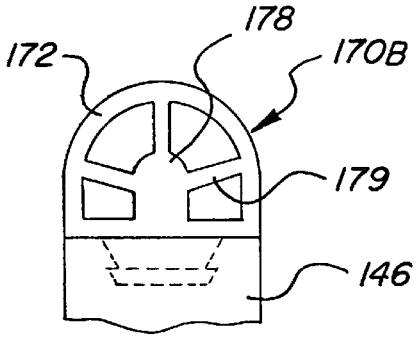
FIG. 12 shows an eighth embodiment having a sixth version of my U-shaped blade support platform which is substantially open and has supporting ribs connected to a central post.

With respect to FIG. 12, an eighth embodiment of the present invention with fourth version 170B of the blade support platform 170B is shown. The blade support platform 170 is provided with horseshoe-shaped a blade seat portion 172 and a centrally disposed portion 178. A plurality of supporting ribs 179 extend from the centrally disposed portion 178 to the blade seat portion 172.

Figure 13A:
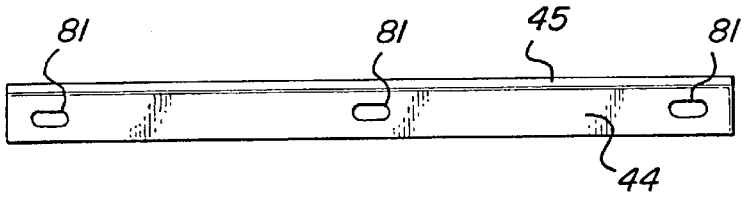

FIGS. 13A–13E show a series of razor-blade strips usable in the various embodiments of the present invention. FIG. 13A shows an elongated razor blade strip 44 having a single sharpened edge 45. The razor blade strip 44 is provided with a series of centered slots 81 through which pins of the blade guard extend.

Figure 13B:
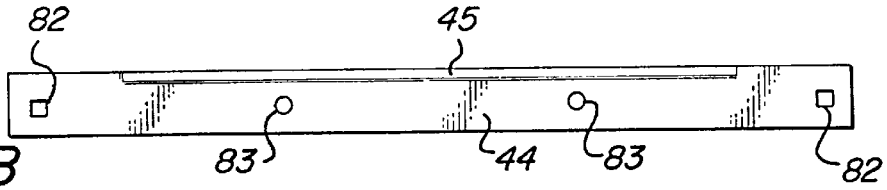

FIG. 13B is a similar razor blade strip 44 having a single sharpened edge 45 which extends only partially along the length of the blade strip 44. A pair of rectangular apertures 82 are provided in each end of the blade strip and a pair of centrally disposed pin holes 83 are provided to permit preassembly of the blade onto a base structure.

Figure 13C:
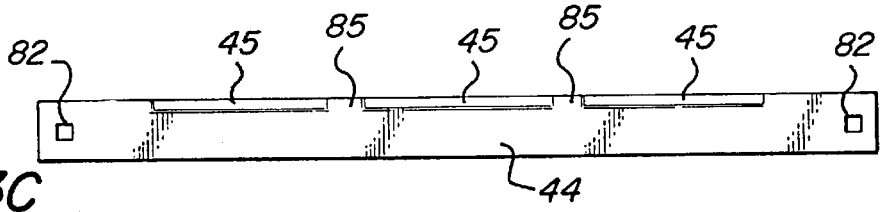

FIG. 13C shows a third razor blade strip having three sharpened edge segments 45 in separate places along one side with unsharpened edge segments 85 therebetween. The unsharpened segments 85 are designed to correspond to the location of the fingers 54 of the guard cage 48. In this way, the fingers 54 of the cage 48 will not be cut by the sharpened edges 45 of the blade strip 44.

Figure 13D:
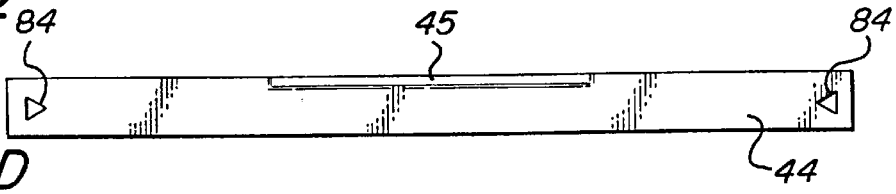

FIG. 13D shows an elongated blade strip 44 with a single sharpened edge 45 which is provided in the central portion of the blade strip 44. The location of the sharpened edge 45 in the central portion provides a nose hair trimming device with end-cutting capability only. A pair of triangular apertures 84 are provided in the ends of the blade strip 44.

Figure 13E:
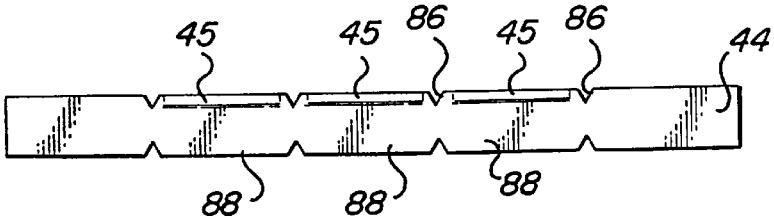

FIG. 13E is an elongated razor blade strip 44 having a plurality of notches 86 to permit the blade segments 88 to flex or be twisted. Twisting of the blade segments 88 may be desirable in order to angle the sharpened edge 45 of the blade in order to improve the cutting angle. The blade seat portion of the blade support platform may also be angled in order to support the notched blade segments 88 in the twisted or angled position.

Figure 14A:
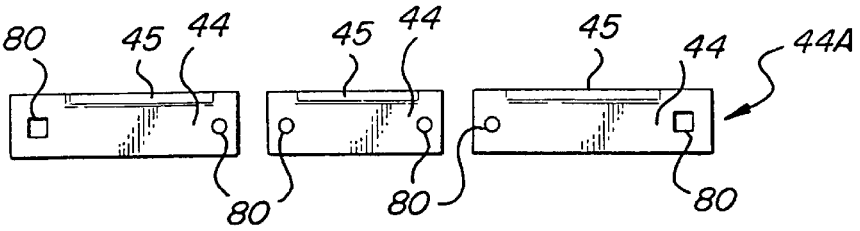
FIG. 14A shows a long segmented razor blade strip structure laid flat consisting of three separate elongated thin flexible blade strips, each having a long razor sharp edge portion and a plurality of pin locating apertures.

FIG. 14A shows a segmented razor blade structure 44A consisting of three separate blade strips 44. Each separate blade strip has a sharpened edge portion 45 and a pair of pin locating apertures 80.

Figure 14B:
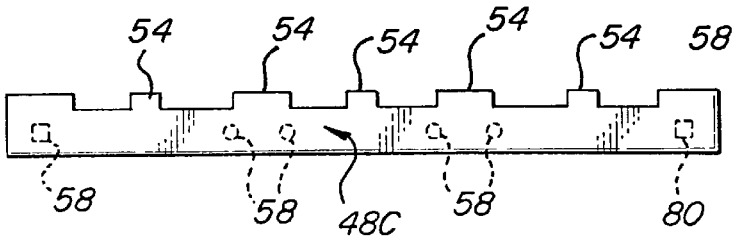
FIGS. 14B and 14C are top and side views of a single-sided semiflexible cage guard structure shown laid flat, which is designed for use with the FIG. 14A segmented razor blade strip structure, with the FIG. 14C view being taken along lines 14C—14C of FIG. 14B and showing the seven overhanging finger segments and the six interlocking pins of the cage guard structure.
Figure 14C:
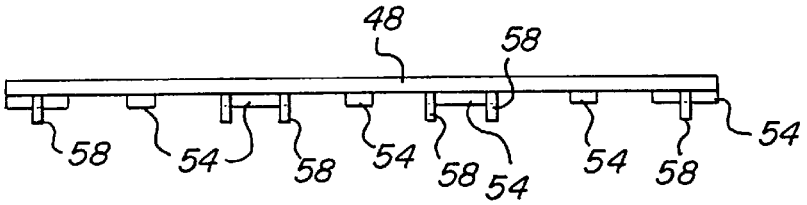

FIG. 14B is a top view of a single-sided guard structure 48C designed for use with segmented blade structure 44A. The guard structure includes a plurality of finger segments 54, some of which correspond to the engagement locations of the separate blade strips 44 shown in FIG. 14A. A plurality of pins 58 are best shown in FIG. 14C on the bottom surface of the guard structure 48. The pins 58 are inserted into the pin locating apertures 80 of the separate blade strips 44 in order to mount the blade strips to the blade support platform.

Figure 15:
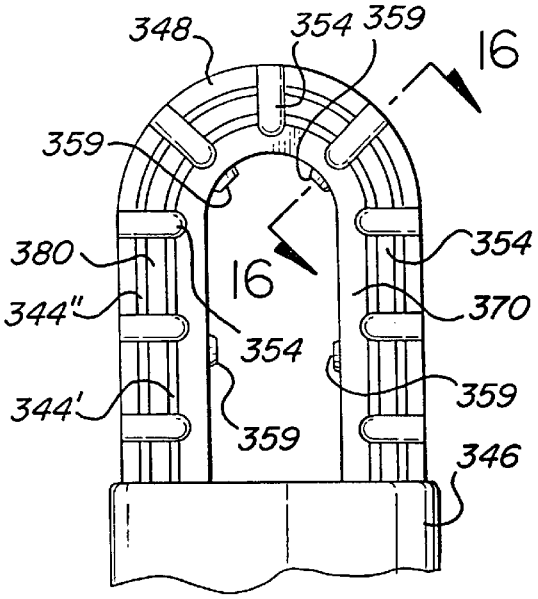
FIG. 15 is a side elevational view of the cutter end portion of a ninth embodiment of the curved blade hair shaving device of the present invention which had two elongated razor blade strips arranged in an evenly spaced relation to one another about a U-shaped blade deck support structure.
Figure 16:
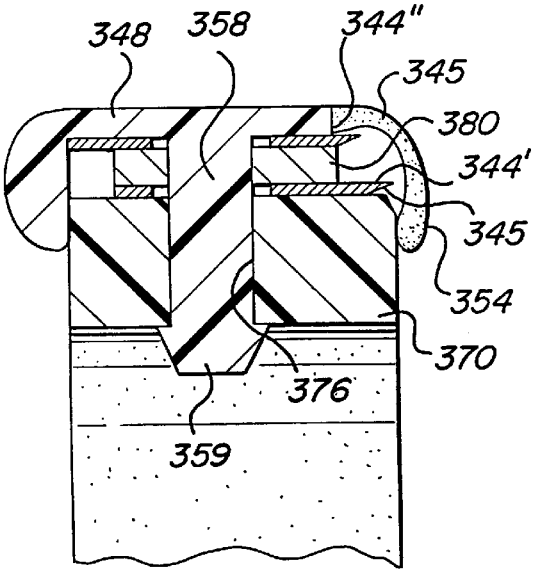
FIG. 16 is an enlarged cross-sectional view, taken along line 16—16 of FIG. 15, showing the spaced arrangement of the two blade strips and an interlocking pin of the cage guard structure passing through the blade strips and blade deck.
Figure 17:
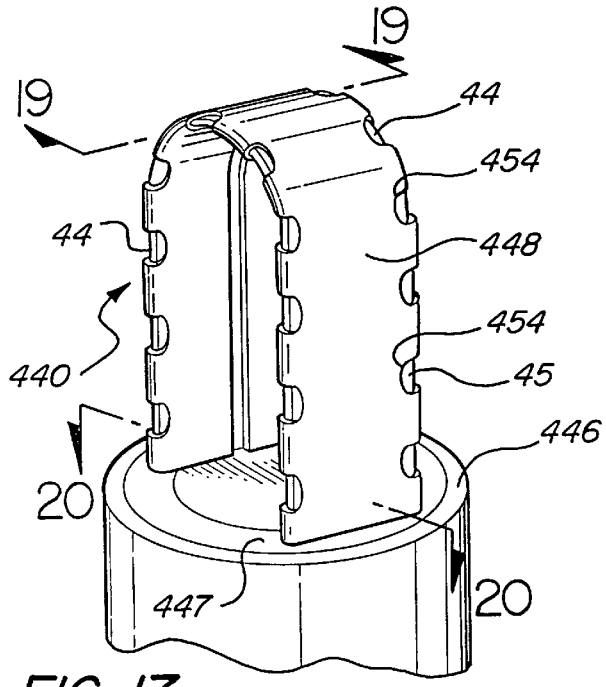
FIGS. 17 through 20 show a tenth embodiment of the nose hair trimmer of the present invention which has a substantially rigid to semi-flexible stainless steel blade strip having two razor sharp edges surrounded by a thin folded metal sheath having a plurality of apertures therein to expose the portions of the sharpened blade edges, where.

FIG. 15 shows, a side view of the cutter end portion of a nose hair trimmer 340 according to a ninth embodiment of the present invention is shown having two blade strips 344', 344". FIG. 16 shows a cross-sectional view taken along lines 16—16 of FIG. 15 illustrating the double blades 344', 344". In FIGS. 15 and 16, a blade support platform 370 is provided with a plurality of apertures 376 disposed therein. A first blade strip 344' is wrapped around the outer periphery of platform 370. A spacer member 380 is then wrapped around the first blade 344' and a second blade 344" is then wrapped around the spacer member 380. The first and second blades 344', 344" and the spacer member 380 are each provided with apertures, not numbered, which receive a pin 358 which extends from a guard cage 348 which is wrapped around the double blade structure. The guard cage 348 is provided with a plurality of fingers 354 which protect a user's skin from contacting the sharpened edges 345 of the first and second blade strips 344', 344". The pins 358 which are provided on the guard cage 348 have a tapered head portion 359 which is extended through the apertures in the first and second blade members 344', 344", the spacer member 380 and the blade support platform 370 in order to interlockingly secure the blade guard cage 348 in place.

Figure 18:
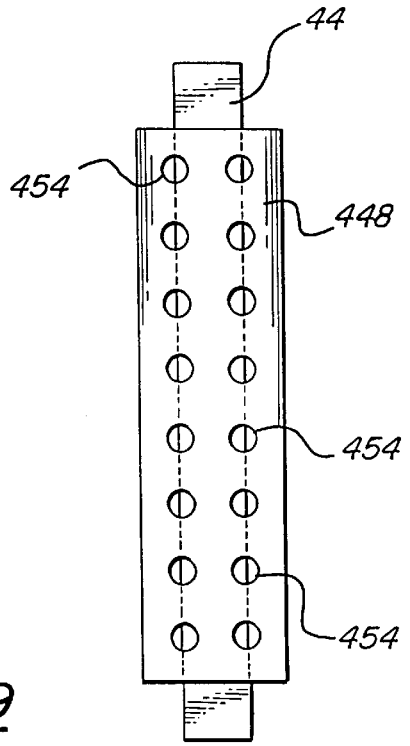
Figure 19:
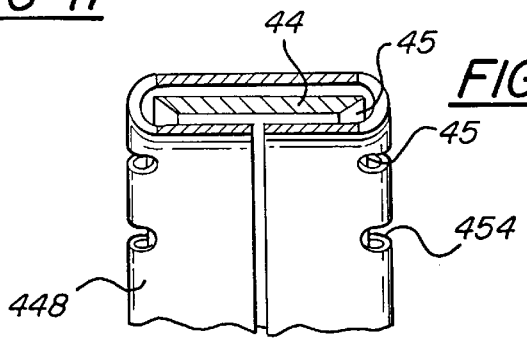
Figure 20:
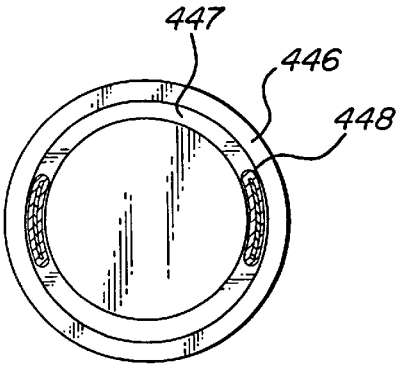

FIGS. 17–20 show a tenth embodiment of the nose hair trimmer 440 of the present invention. According to this embodiment, a double-edged blade strip 44 is provided within a stainless steel blade housing or guard 448. The housing 448 is provided with a plurality of apertures 454 which expose the sharpened blade edge 45, while guarding the user's skin against nicks. The housing 448 is formed by providing a flat strip 448 with a plurality of apertures 454, as shown in FIG. 18. The flat strip 448 is then wrapped around the blade strip 44 to form a sleeve-like guard as shown in cross-section in FIG. 19. The blade housing 448 may be secured to the base portion by any means. FIG. 20 shows two concentric metal rings 446, 447 snapped together which hold the metal blade 44 and blade housing 448 in place. The blade housing 448 may be welded to the ring 447 or held in place by other known means.

Figure 21:
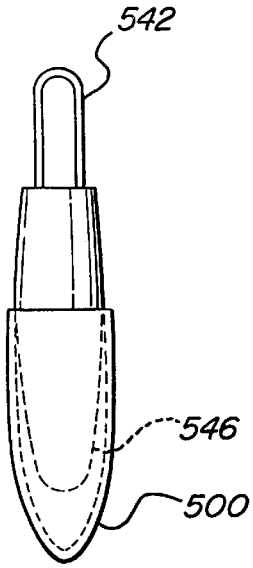
FIG. 21 shows an eleventh embodiment of the present invention, which includes a fingergrip-sized base connected to the nose hair trimming end portion, with a plastic cap disposed over the base and ready to be placed over a cutter end when not in use.
Figure 22:
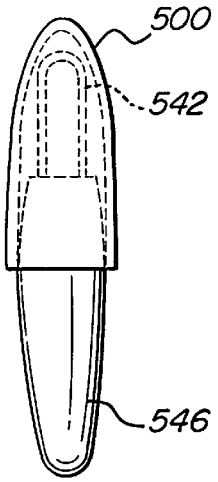
FIG. 22 shows the FIG. 21 device with cap in place covering the cutter end.

With respect to FIG. 21, an eleventh embodiment of the present invention is shown which includes a fingertip-sized base 546 connected to the nose hair trimming head structure 542. A plastic cap 500 is also provided which can be inserted on either end of the fingertip-sized base 546. When the plastic cap 500 is placed over the fingertip-sized base 546 as shown in FIG. 21, the plastic cap 500 can also be used as a handle portion. The U-shaped nose hair trimming head structure 542 can be any of the above-described types. In FIGS. 21 and 22, the U-shaped nose hair trimming portion is merely drawn schematically. With the plastic cap 500 covering the head structure 542, as shown in FIG. 22, the device can be easily carried in a user's pocket, purse or cosmetic case.

With respect to FIGS. 23A–23D, a twelfth embodiment of the nose hair trimmer of the present invention is shown. In FIG. 23A, a flat piece of metal 600 is shown having a base portion 646 and an elongated strip 644 having two sharpened edges 45. The base portion 646 is rolled in order to form a handle portion as shown in FIGS. 23B and 23C. The blade portion 644 is then bent to form a U-shaped hook blade connected at only one end 648 to the base portion. In FIG. 23D, a stainless steel blade housing or sleeve 448 is shown being slid over the blade portion 644. The stainless steel blade housing 448 is similar to that disclosed in FIGS. 17–19. It is also noted that as an alternative to the embodiment shown in FIGS. 23A–23D, the blade housing may be integrally formed with the base portion of a single sheet of metal instead of the blade member. In this way, a separate blade strip can then be inserted into the blade housing which is integrally formed with the base portion. In either embodiment, the blade strip and the blade housing can be welded, soldered, glued, or held to one another by any other known means.

With respect of FIG. 24, an alternative blade construction is schematically shown wherein the cutting blade includes two separate blades 744', 744" each embedded in an oval cross-section base support structure 746. Each blade strip 744', 744" is curved toward one another at their end portions to form a substantially U-shaped cutting surface with an opening therebetween. A guard structure of any of the types disclosed above can be used in conjunction with this blade structure.

With respect to FIGS. 25–28, alternative shapes for the curvature of the blade strip are shown. One of ordinary skill would of course recognize that the blade strip can be bent in or otherwise performed into many shapes without departing from the scope of the present invention.

FIGS. 29–33 show a fourteenth embodiment of the present invention, which includes a double-edged flexible razor blade strip 844 located adjacent to a flexible guard member 848, in a planar arrangement. Like blade strip 44, blade strip 844 is typically constructed from stainless steel, although other suitable materials may be used. The guard member 848 may be made from plastic or any other suitable material. The blade strip 844 and the guard member 848 are intended to be flexible and bendable to a substantially curved, or U-shaped configuration. The double-edged blade strip 844 includes two sharpened blade edges 845. The guard member 848 is preferably of greater overall width than the double-edged blade strip 844. Accordingly, the guard member 848 is provided with a plurality of apertures 854 at spaced intervals along both edges which expose the blade edges 845 at spaced intervals. The apertures are sized to a distance, from the edges of the guard member 848, beyond that to which the blade edges 845 protrude. In this way, hairs may be cut by the blade edges 845 within the apertures 854 upon movement of the device as a whole along the skin or body cavity surface containing hairs. It will be noted that the sidewalls of the apertures 854 may preferably be slanted or curved toward each other from the edge of the guard member 848 inward. This configuration tends to enhance the movement of hairs toward a smaller area of the blade strip edge, enhancing the cutting ability of the device by restricting lateral movement of hairs along the blade edge when there is only modest force of the hairs against the blade edge. This principle is utilized further in other embodiments described below which utilize V-shaped blade surfaces and guard member recesses.

The guard member 848 further includes an anchoring prong 851 at each end. The prongs 851 are suitable for securing the ends of the guard member 848 into a suitable support platform or handle attachment, such as those shown previously, when the blade strip 844 and the guard member 848 are bent into a curved configuration, such as a U-shaped configuration. The guard member 848 is provided with a plurality of centrally-located pins 858 which are inserted in corresponding pin receiving holes 880 in the blade strip 844 for retaining the engagement between the blade strip 844 and the guard member 848. Preferably, the pins 858 are integrally formed upon one surface of the guard member 848 and are of the same material. Apertures 890 are also provided upon prongs 851 to allow the passage of an engagement device of any suitable kind for retaining the guard member 848 in a curved configuration within the particular blade support platform being used. Those in the art will appreciate that guard member 848 can thus be used to carry and support blade strip 844. Blade strip 844 and guard member 848 may be mounted to a suitable support platform or handle at both ends, so as to enhance comfort and safety during use. It will be appreciated that this embodiment may take on other suitable characteristics, such as a single-edged blade strip. Additionally, prongs 851 may form part of blade strip 844 instead of guard member 848, or the prongs may be formed in both blade strip 844 and guard member 848, with apertures through each.

FIGS. 32 and 33 show two cross-sectional views relative to FIG. 29, illustrating the projection of locating pins 858 through the pin-receiving holes 880 in the blade strip 844. It will be appreciated that holes 880 may be of any suitable shape and/or configuration to achieve the desired engagement, including a press-fit engagement with pins 858. As shown in FIG. 33, apertures 854 on the guard member 848 are preferably of a generally concave shape when viewed on end, although it will be appreciated that any suitable shape may be used.

In FIGS. 34 and 35, two alternative embodiments for the engagement of the blade strip 844 and the guard member 848 are shown. FIG. 34 shows an arrangement where the pins 858 from the previous embodiment may be replaced with a plurality of interlocking nape-prongs 892. The nape-prongs 892 are also preferably integrally formed upon one surface of the guard member 848 and are of the same material. In this arrangement, the nape-prongs 892 are squeezed for engagement into (or disengagement from) the pin receiving holes 880 of the blade strip 844. In FIG. 35, the pins 858 are replaced by plastic rivets 894 that are also preferably integrally formed upon one surface of the guard member 848 and are of the same material. The rivets 894 are initially provided in the configuration of cylindrical stumps, shown by the outline at 896. Once inserted within the pin hole 880, the rivet 894 is converted into the button shape shown, through partial melting, mechanical deformation, or any other suitable method.

Figure 36:
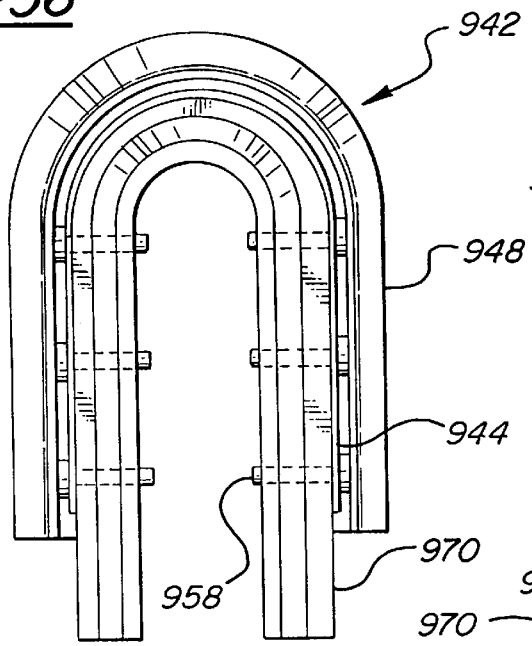
FIGS. 36, 37 and 38 illustrate a fifteenth embodiment of the nose hair trimming device of the present invention which employs three major elements, namely a U-shaped inner platform, razor blade strip and cap member, where.
Figure 37:
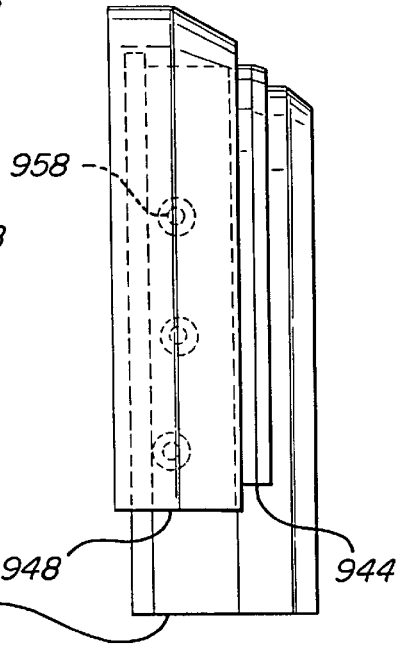
Figure 38:
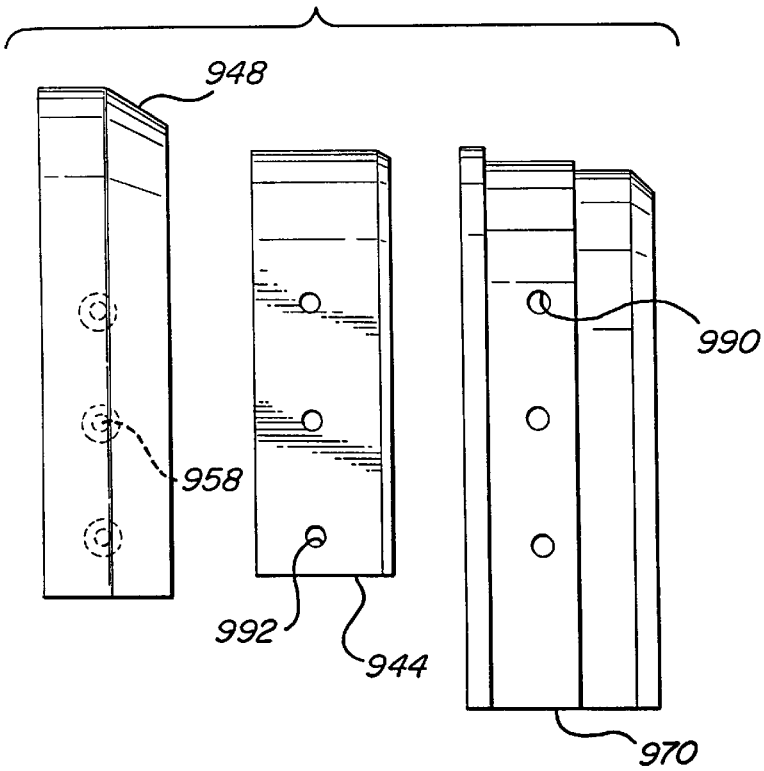

FIGS. 36–38 show a fifteenth embodiment of the device of the present invention which includes a U-shaped head structure 942, shown in assembled form in FIGS. 36–37 and in an exploded side view in FIG. 38. The head structure 942 includes an inner platform 970, a blade strip 944 and a cap member 948. Each component may be provided initially in a planar configuration, and then may be bent to a curved, or U-shaped, configuration for assembly. The assembled head structure 942 may be secured to any suitable base portion or handle attachment, such as those described herein. As shown in the exploded view of FIG. 38, the inner platform 970 and the blade strip 944 are each provided with apertures 990 and 992 respectively, which receive pins 958 extending from the cap member 948. When the inner platform 970, blade strip 944 and cap member 948 are brought together and bent in a cooperating curved relationship, the pins 958 secure these components to form the head structure 942. In use, movement of the head structure along the surface to be trimmed causes hairs to be cut by the blade strip 944 along a working plane created by the sloped front surface portion 971 of the inner platform 970 and sloped (rear) surface portion 973 of cap member 948.

Figure 39:
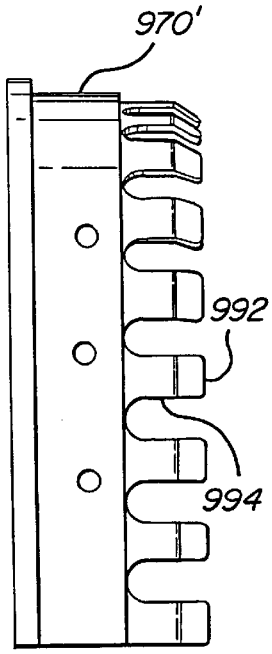
FIG. 39 shows an alternate inner platform for the fifteenth embodiment, which has fingers and slots in its forward region.

FIG. 39 shows an alternative configuration for the inner platform 970 described in FIGS. 36–38, referenced at 970'. In this configuration, the inner platform 970' is shown to include a plurality of fingers 992 separated by a plurality of recesses 994. The fingers 992 are preferably of a length similar to or the same as the distance to the front edge 975 of the inner platform 970. Thus, the fingers 992 provide a discontinuous or slotted guard at the surfaces 971 of the fingers 992 of an adjacently-disposed blade strip for guarding against contact of the blade strip with the skin, as previously described. The exposure of sections of the blade strip edge between the fingers 992, however, allows hairs to contact the razor-sharp edge of blade strip between the fingers 992, so that the hairs will be cut by the blade strip as the assembly is moved along the skin surface, such as the skin with the ear or nose, to be trimmed. The fingers 992 are preferably shaped to have a generally curved configuration, as shown when viewed from the side, to avoid skin scrapes, and may also preferably include slanted or sloped end portions 971 as well, for enhancing comfort and safety during use. Similarly, the recesses 994 are of a generally curved shape, although other suitable shapes, such as a V-shape, may also be used. It will be appreciated that this configuration for the inner platform 970' may be adapted for use with any of the embodiments described herein.

With respect to FIGS. 40–42, there is shown a sixteenth embodiment of the present invention. According to this embodiment, a head structure 1042 has a serrated blade strip 1044. The serrated razor blade strip 1044 is preferably formed in the configuration of a thin, flat strip, as shown in FIG. 42, which is bendable to the curved, or U-shaped, configuration shown in FIGS. 40 and 41. The serrated blade strip 1044 includes a plurality of V-shaped notches 1045 located along one of its edges. It will be appreciated that the opposing edge may also include notches or other useful configurations as well. The notches 1045 are shown to be sharpened to razor-sharp cutting edges along a substantial surface of each notch. As previously described, the use of a V-shaped notch enhances the ability of the device to direct hairs toward the preferred cutting location at the rear of the notch upon movement by hand. In addition, the use of a V-shaped sharpened cutting surface allows for lower production costs, due to the use of multiple, spaced V-shaped sharpening wheels during manufacture.

As can be seen in FIGS. 40–42, the notches 1045 may preferably be sharpened to a distance short of the edge of the serrated blade strip 1044. In this arrangement, the sharpened surfaces of the notches 1045 will not directly contact any skin or cavity tissue that the edge of the serrated blade strip 1044 may contact, thereby enhancing comfort and safety during use. It will be appreciated that the notches 1045 may also be provided in other suitable configurations and may be provided in any suitable spacing.

The serrated blade strip 1044 also includes an aperture 1090 at each end, for securing the serrated blade strip 1044 to a suitable support platform or handle or cartridge base. FIGS. 40 and 41 show the serrated blade strip 1044 in a curved, or U-shaped, configuration mounted to a cartridge base 1071, and removably and interlockingly disposed in a complementary bore 1047 within base portion 1070 in a sliding, press-fit arrangement.

Cartridge base 1071 is securable in a retained position within the aperture 1047 on a limited basis through the engagement of one or more protrusions or tabs 1091 disposed in the aperture 1047 with one or more slots 1093 disposed at corresponding locations upon the base 1071. The prong 1071 may be extended lengthwise within the aperture 1047, or removed entirely, by applying sufficient pulling force to overcome the engagement force of the tabs and slots. It will be appreciated that the arrangement of tabs and slots may be reversed, and that the tab and slot feature may be used with other features of the present invention as may be suitable for retaining various components in a particular position on a limited basis. In addition, other suitable features may be substituted for the tabs and/or slots to accomplish a limited retention situation.

The serrated blade strip 1044 is secured to the base portion 1071 by pins 1079. When the cartridge base 1071 is fully inserted within the aperture 1047, as shown in FIG. 40, the serrated blade strip 1044 is maintained in a substantially axial configuration relative to the base portion 1070 due to the constraints upon the lower edges of the serrated blade strip 1044 by the upper cylindrical portion of the base portion 1070. In the use of this embodiment of the device, movement of the serrated blade strip 1044 in the direction of the notches 1045 along a surface to be trimmed allows hairs to become directed within the notches 1045 and cut.

FIG. 43 shows a serrated blade strip 1044, of the type shown in FIGS. 40–42, in a flattened arrangement, with a serrated plastic guard member 1048 disposed thereon. The serrated guard member 1048 is shown to include a plurality of notches 1054 that correspond to the notches 1045 in the serrated blade strip 1044. Notches 1054 protrude inwardly from the edge corresponding to that on the serrated blade strip 1044 containing the notches 1045, but preferably are wider than, and extend beyond the depth of, the notches 1045 in the serrated blade strip 1044. In this configuration, the guard member 1048 does not cover, or otherwise obscure, the razor-sharp edges of V-shaped notches 1045. Serrated guard member 1048 preferably extends beyond the edges of the serrated blade strip 1044 at those locations between adjacent notches 1045, to provide further protection for the skin from contacting of the serrated blade strip 1044 during use, as is illustrated in FIGS. 43 and 46. The edges of the serrated guard member 1048 may also be partially wrapped over the elongated edge of blade strip 1044, as shown in FIG. 47, if desired. The serrated guard member 1048 is also designed to be of a flexible material, such as plastic or stainless steel, so that it may be bent into a curved configuration with the serrated blade strip 1044. It will be appreciated that the serrated blade strip 1044 may also include notches along both edges, and may include a correspondingly shaped serrated guard member, as described below.

FIGS. 44 and 45 illustrate one method for securing the ends of the removable head structure 1042 set forth in FIGS. 40–43 to a corresponding base portion, handle attachment or cartridge base. FIG. 44 shows one end portion of a head structure 1042 which is in a curved configuration as set forth above. The end portion of the head structure 1042 includes the end portion of a serrated blade strip 1044 surrounded by the end portion of a serrated guard member 1048, as before. The serrated blade strip 1044 includes an aperture 1090 formed near its end. The base 1071 to which the head structure 1042 is attached is shown to include a suitable mounting structure for attachment of the serrated blade strip 1044 through the use of the aperture 1090. In the embodiment shown in FIGS. 44 and 45, this is preferably provided through a pair of recesses 1092 and 1094, which are shaped to match the configurations of the end of the serrated blade strip 1044 and a pin 1079 used to secure the engagement. As shown in FIG. 45, the end of the serrated blade strip 1044 is inserted within the recess 1094 so that the pin 1079 may be inserted through the aperture 1090 and pressed into recess 1092, thereby completing the engagement. It will be appreciated that other suitable arrangements for attaching the head structure 1042 to the prong 1071, or directly to the base portion 1070 or other attachment, may be used. It will also be appreciated that this type of attachment method may be used for any attachment needed in accordance with this invention.

With respect to FIGS. 46 and 47, two alternative configurations are shown for the engagement of the serrated blade strip 1044 and the serrated guard member 1048. In FIG. 46, the engagement between these two components is accomplished by having the ends of the serrated guard member 1048 surround the ends of the serrated blade strip 1044. An alternative arrangement is shown in FIG. 47, where the ends of the serrated guard member 1048 do not surround the ends of the serrated blade strip 1044. Instead, a pin 1058, such as that shown in FIGS. 32 and 33, may be used to fingergrip 1044 and the serrated guard member 1048. Alternatively, a nape-prong or a rivet may be used, as described in connection with FIGS. 34 and 35.

FIGS. 48 and 49 illustrate a seventeenth embodiment of the device of the present invention. According to this embodiment, a head structure 1142 includes a serrated blade strip 1144 having razor-sharpened notches 1145 along both of its edges. The head structure 1142 also includes a serrated guard member 1148 having notches 1154 along both edges corresponding to the notches 1145 in the serrated blade strip 1144. In similar manner as before, the notches 1154 are sized to be deeper than the notches 1145 as measured from the edge of the serrated blade strip 1144, so that substantially all of the sharpened surfaces of the notches 1145 are exposed. Also, in similar manner as before, the overall width of the serrated guard member 1148 may preferably be greater than the overall width of the serrated blade strip 1144, so as to protect against contact with the skin by the edges of the serrated blade strip 1144. The head structure 1142 may be attached to a base cartridge or handle in any manner previously described.

Figure 51:
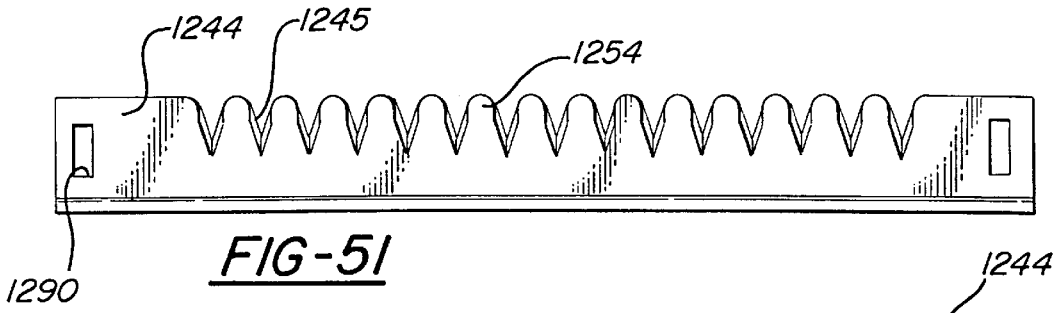
FIGS. 50 and 51 illustrate an eighteenth embodiment of the hair trimming device of the present invention, with FIG. 50 being a front perspective view thereof and FIG. 51 being a plan view of the razor blade strip in FIG. 50 showing that one longitudinal edge of the blade strip is provided with serrations in the form of razor sharp V-notches with rounded regions therebetween and the second longitudinal edge is provided with a straight razor sharp edge.
Figure 52:
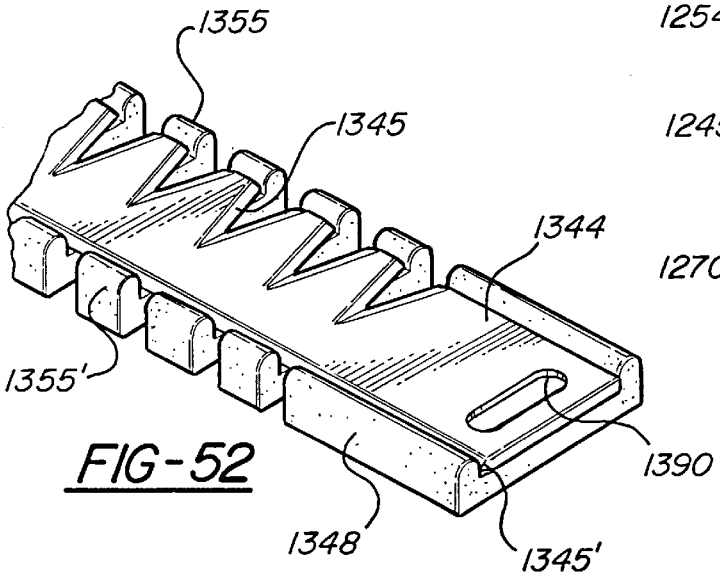
FIGS. 52 through 55 illustrate a nineteenth embodiment of the hair trimming device of the present invention which includes a flexible serrated razor blade strip provided with a plurality of V-notches, and a straight razor sharp edge, which strip is received by a serrated flexible inner guard strip where.
Figure 50:
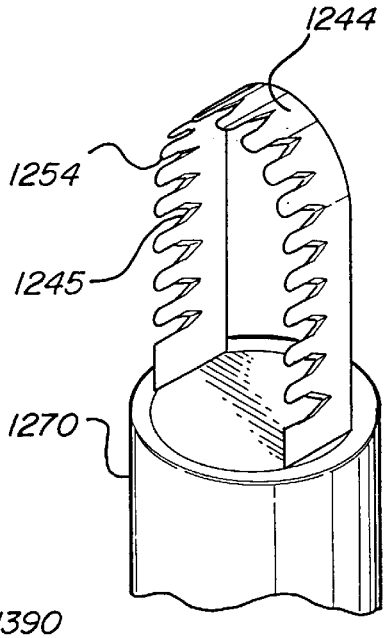
Figure 55:
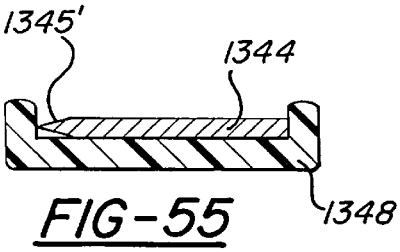
Figure 54:
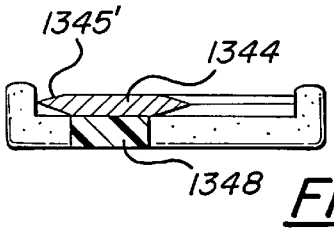
Figure 53:
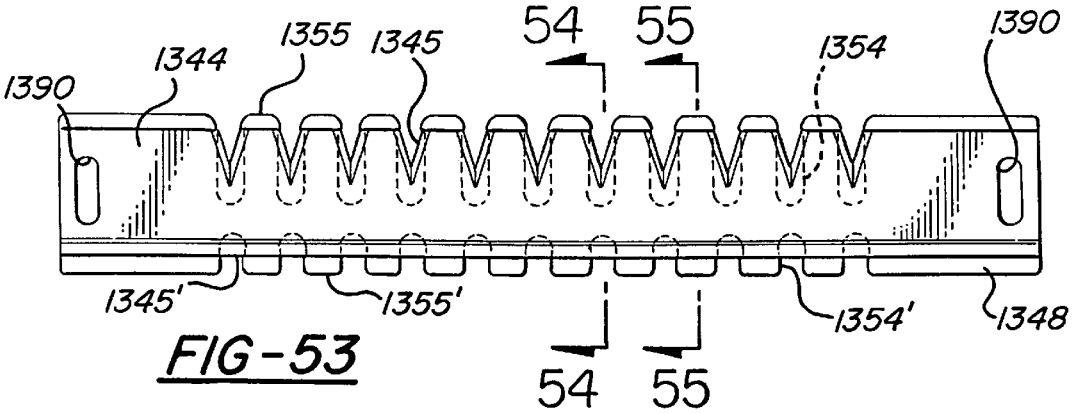

FIGS. 50 and 51 illustrate an eighteenth embodiment of the device of the present invention. According to this embodiment, a flexible serrated flat blade strip 1244 is shown to include a plurality of V-shaped razor-sharp notches 1245 along one longitudinal edge. If desired, the opposite edge can be ground to a straight razor-sharp edge as best shown in the FIG. 52 embodiment. Between the notches 1245 are a plurality of fingers 1254 shaped in such a way to minimize any scraping irritation against the skin. As shown in FIGS. 50 and 51, the fingers 1254 are shown to be of a substantially rounded configuration, although it will be appreciated that any suitable gently curved configuration may be used. The serrated blade strip 1244 includes apertures 1290 at each end for attachment to a suitable base portion or handle attachment. As shown in FIG. 50, the flattened serrated blade strip 1244 is placed in a curved configuration and is attached at each end to the base portion 1270. The attachment of the ends of the serrated blade strip 1244 may be accomplished using a similar type of engagement as shown in FIGS. 44 and 45, or any other suitable attachment method. Serrated blade strip 1244 may also be attached to a suitable cartridge base for removable attachment to a suitable handle or fingergrip base portion, if desired. It will also be appreciated that any of the slotted blade guards previously described may be used. This embodiment of hair trimming device is used by moving the base portion 1270 in a forward direction relative to the notches 1245 so that hairs become entrapped within the notches 1245 and cut from two sides which is best illustrated in FIG. 59 below.

With respect to FIGS. 52–55, a nineteenth embodiment of the device of the present invention is shown. In this embodiment, a serrated blade strip 1344 is provided, having the ability for cutting along both edges, in two directions, along with a suitable slotted flexible guard member 1348. This cutting in two directions is accomplished in this embodiment through the use of two different types of razor-sharp cutting arrangements. The serrated blade strip 1344 includes V-shaped razor-sharp notches 1345 along one edge, in similar manner to the embodiments previously described. The serrated blade strip 1344 also includes a sharpened blade edge 1345' along the opposing longitudinal edge. A notched guard member 1348 is also shown in engagement with the serrated blade strip 1344. The notched guard member 1348 is configured with angled edges that substantially surround the edges of the serrated blade strip 1344 and prevent the user's skin from being scratched by the front edges of the V-shaped notches. It will be appreciated, however, that other suitable configurations for the notched guard member 1348, such as those described herein, may also be used. The notched configuration of the guard member 1348 results in the presence of fingers 1354 and 1354' along the opposing edges of the guard member 1348. Guard member 1348 is preferably notched to a depth from each edge sufficient for exposure of both the sharpened notches 1345 and sections of the blade edge 1345'. In this embodiment, however, the U-shape of the notches 1354 causes a portion of the sharpened notches 1345 less than the entire surface to be exposed. It will be appreciated that this fingered configuration for the blade strip guard may be used for any of the notches described herein. In the use of this embodiment of the device, movement of the serrated blade strip 1344 in either direction will result in hairs becoming trapped between the various fingers 1354 for cutting by the notches 1345 or the blade edge 1345'. In addition, the serrated blade strip 1344, shown in a flattened arrangement, can be curved and mounted in a suitable base portion or handle attachment as in previous embodiments. For this reason, apertures 1390 are provided in the serrated blade strip 1344, with matching apertures (not numbered) also located within the notched guard member 1348. Alternatively, it will be appreciated that either the serrated blade strip 1344 or the notched guard member 1348 may extend beyond the other in an axial direction, so that only one of these components is mounted directly to a suitable base portion or handle attachment.

Figure 56:
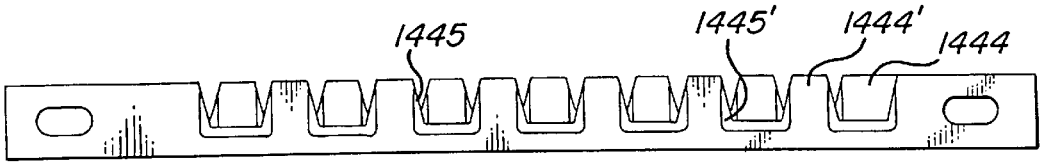
Figure 57:
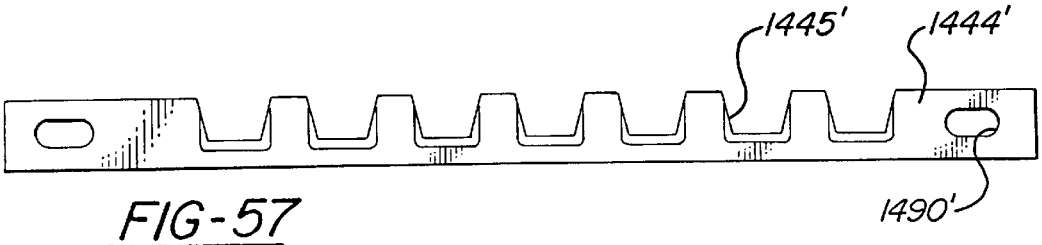
Figure 58:
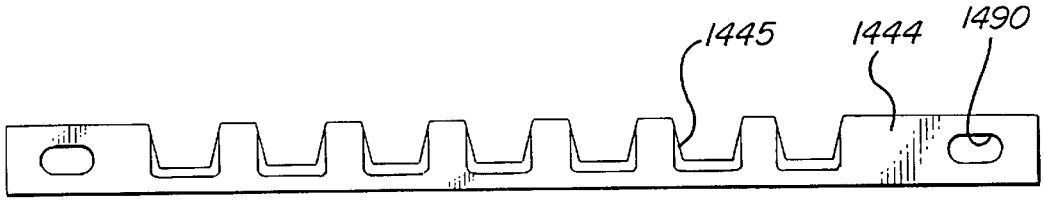

FIGS. 56–59 illustrate a twentieth embodiment of the present invention. In this embodiment, a plurality of blade strips are placed together in an offset configuration to provide a series of sharpened V-shaped notches for cutting hairs. FIGS. 58 and 57, respectively, show two serrated blade strips 1444 and 1444'. These blade strips are configured to include notches 1445 and 1445' having slanted side edges and a base oriented in a substantially axial direction relative to the blade strips 1444 and 1444'. The notches 1445 and 1445' may be sharpened over a substantial amount of their edge surfaces. As seen in FIGS. 56–58, the notches 1445 and 1445' may be sharpened along the base surface and along the side surfaces in a more perpendicular configuration, preferably so that a portion less than all of the slanted side surfaces of the notches 1445 and 1445' is sharpened. In alternative arrangements, the notches 1445 and 1445' may be cut and/or sharpened in other configurations as may be suitable for providing just the desired razor-sharp cutting surfaces in the working areas of the V-shaped notches. The notches 1445 and 1445' are created within the respective blade strips 1444 and 1444' in an offset configuration, such that the cooperation of the notches of these two blade strips in an aligned side-by-side relation produces a series of V-shaped razor-sharp surfaces suitable for severing hairs. FIG. 56 shows the union of the two serrated blade strips 1444' and 1445' to include such V-shaped cutting surfaces.

Figure 59:
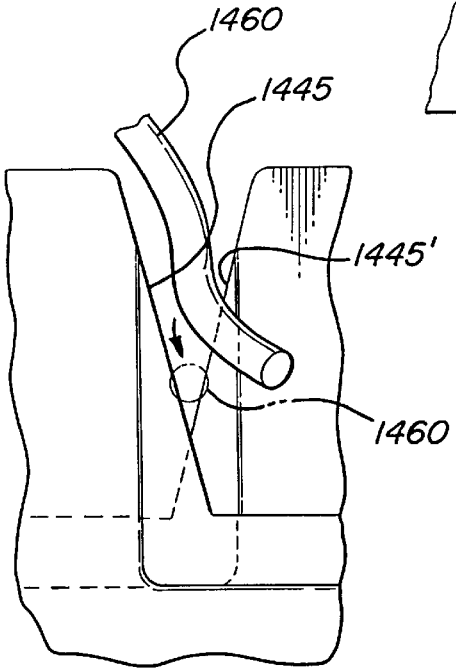

As shown in greater detail in FIG. 59, movement of the blade strips 1444 and 1444' in the direction of a hair strand 1460 guides the hair strand 1460 into a cutting position, referenced at 1460' in FIG. 59, so that the hair strand is effectively captured and severed from two substantially opposed sides. This technique provides a highly effective almost effortless cutting action. The blade strips are also provided with corresponding apertures 1490 and 1490', so that the blade strips may be curved into a configuration suitable for engagement with a base portion or handle attachment, in similar manner as previously described. One advantage of this configuration of blade strips is that the sharpened notch surfaces 1445 and 1445' can be manufactured at lower cost. It will be appreciated that the blade strips of this embodiment may be used with any configuration of the guard members previously described and may also be configured as a pair of double-edged blade strips.

Figure 60:
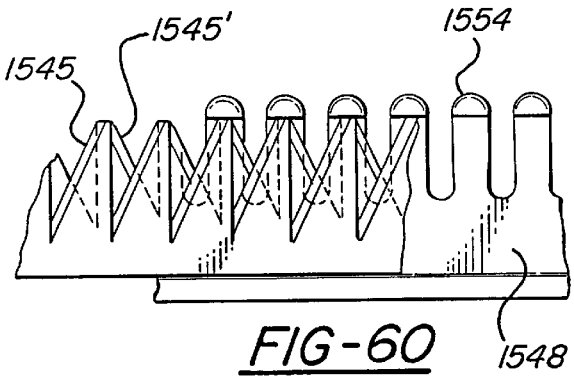
Figure 61:
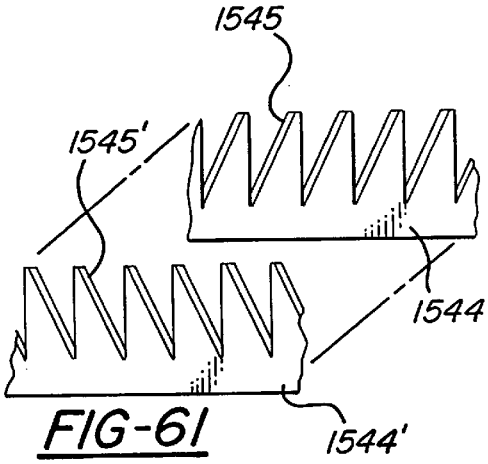

FIGS. 60 and 61 illustrate a twenty-first embodiment of the present invention, in which a plurality of serrated blade strips is also provided in an offset configuration. In this embodiment, however, the serrated blade strips 1544 and 1544' are shown to include notches 1545 and 1545' in a slanted V-shape with one edge perpendicular to the longitudinal axis of the blade strip and the other sharpened edge at an angle thereto. In this embodiment, only one edge of each notch is sharpened. The sharpening of opposing notches 1545 and 1545' of the opposing serrated blade strips 1544 and 1544' allows the cooperation of the blade strips when brought together to form a V-shaped cutting surface similar to those in the embodiments previously described. It will be appreciated that this arrangement of opposing cutting surfaces may be utilized for any embodiment herein where two blade strips are used. As shown in FIG. 60, the serrated blade strips 1544 and 1544' may optionally be fitted with a serrated guard member 1548, in similar fashion as in previous embodiments. The serrated guard member 1548 may preferably be of a width greater than that of the serrated blade strips 1544 and 1544' and may preferably include fingers 1544 along one edge, to provide protection against contact of the blade strip edges with the skin. The guard member 1548 is preferably notched from one edge to a distance greater than that of the V-shape formed by the cooperation of opposing notches 1545 and 1545'. In this way, the cutting surfaces of the notches 1545 and 1545' are exposed between the fingers 1554. The fingers 1554 may preferably be of a generally rounded configuration, as shown in FIG. 60, for reducing irritation during contact with the skin. In operation, movement of the serrated blade strips 1544 and 1544' in the direction of the openings provided by the notches 1545 and 1545' results in hairs becoming entrapped within the V-shape formed by the notches, resulting in a rapid easy cutting of the hairs. It will be appreciated that this embodiment may include the use of double-edged blade strips as in previous embodiments, as well as the use of a serrated guard member having two configured edges. In addition, this embodiment may be coupled with an appropriate base portion or handle structure by curving the serrated blade strips 1544 and 1544' in the manner previously described, and affixing the ends of the blade strips to such base portion or handle attachment.

My razor-sharp nose hair trimming devices can each be implemented as a structure that is symmetrical or asymmetrical about an imaginary central longitudinal axis which extends through the forward blade-supporting portion and fingergrip portion. Unless otherwise indicated, the devices shown herein are symmetrical about the central plane of the overall device, in which the central longitudinal axis is found. Thus, those in the art should appreciate that the descriptions herein of one side, end, or section of any given cutting head or handle in general will also serve to describe the other half of said symmetrical structure on the opposite side of the central imaginary axis or central longitudinal plane.

The small overall size of the device permits fingertip holding, which results in better control of the cutting action. This enables the user to cut with a light touch as he (or she) trims the body hair in the cavity. Precise or detailed control and positioning is further facilitated by the light weight of the device.

With the cover, which can be cap-like or sleeve-like, which cover can be used with any of the described devices, a convenient nose hair trimming system is provided which is sanitary, safe, easily usable and sufficiently inexpensive that it may be discarded after a limited number of uses.

While the above embodiments have been described in connection with particular examples, it will be recognized that any of the features set forth with regard to any of the particular embodiments may be used with other embodiments and/or in combinations of other embodiments to accomplish the desired result.

Further, although the foregoing embodiments are discussed with respect to the nostril hair trimming, those skilled in the art will appreciate that these same devices may also be used for trimming hair within any close quarters, such as within or near certain small body cavities of humans or animals. Examples of such close quarters include human or animal ears and within animal paws. Thus, the device of the present invention is intended to be applicable to a wide variety of applications for both human and animal care (such as certain breeds of dogs that have hair growing within their outer ears) or other parts of a person's or an animal's body where small depressions or cavities are present where hair to be trimmed is present. Also, those in the art will appreciate that barbers, health care professionals, geriatric attendants and other care-givers may safely use the shaving trimmers of the present invention to cut the nostril and/or ear hair of their customers and/or patients.

Those skilled in the field will appreciate that the foregoing illustrated and discussed embodiments of the shaving devices of the present invention are subject to modification and change without departing from the scope of the invention as recited in the claims below. Needless to say, the overall size, proportion, materials, weight and clearances of the various components used in the razor-holding portions, the fingergrip sized portions, and connection mechanisms for attaching the blade strip to the body of the shaving devices of the present invention can be varied as needed or desired. A number of other possible modifications have already been described above. Further changes are clearly possible, as different features and aspects of one embodiment may be combined with another embodiment to provide a nose hair trimming device with the desired features from both.

Thus, it is to be understood that the present invention is by no means limited to the particular constructions herein disclosed and/or shown in the drawings. Instead, the present invention also encompasses any modifications or equivalents within the scope of the disclosures that are fairly covered by the claims set forth below.

I claim:

1. A hand-held, lightweight manually operated, finger-manipulatable non-electric razor device for shaving hair from a body cavity surface, comprising:

a head structure sized to fit within a cavity of a human body, the head structure including a flexible razor blade strip formed from a very thin elongated strip of flat razor blade material and having first and second ends and a first longitudinal edge, the razor blade strip being bent in a central section thereof to provide a curved section disposed between first and second straight sections substantially parallel to one another and positioned on either side thereof and terminating respectively at the first and second ends; and a handle connected to at least one of the first and second ends of the razor blade strip;

the razor blade strip having a plurality of exposed razor-sharp cutting regions spaced from one another along at least the first longitudinal edge thereof, each cutting region having an exposed razor-sharp cutting edge for cutting hair strands positioned in contact therewith.

2. The razor shaving device as in claim 1, wherein the head structure further comprises a guard member disposed adjacent to the razor blade strip, the guard member including a plurality of spaced apart projections operable for shielding the razor blade strip from direct contact with a body surface over which the device is moved, and wherein in each of the plurality of cutting regions, there is at least one razor-sharp cutting edge of the razor blade strip exposed between the projections.

3. The razor shaving device as in claim 1, wherein the head structure further comprises at least one guard member disposed upon the razor blade strip and having a plurality of spaced apart notches adjacent to the razor-sharp cutting edges, the guard member having a configuration suitable for shielding the razor blade strip from direct contact with a body surface over which the device is moved, and wherein at least one of the plurality of cutting regions has at least one razor-sharp cutting edge of the razor blade strip exposed through a plurality of spaced apart notches in the guard member.

4. The razor shaving device as in claim 1, wherein the exposure of at least one razor-sharp cutting edge in the central section of the first longitudinal edge of the razor blade strip allows the distal end of the device furthest from the handle to cut hairs upon movement of the razor-sharp cutting edge toward the hairs to be cut.

5. The razor shaving device as in claim 1, wherein the head structure further comprises a guard member disposed upon the razor blade strip, the guard member including a plurality of fingers disposed near the razor-sharp cutting edges of the razor blade strip, the fingers being positioned and operable to shield adjacent exposed razor-sharp cutting edge of the razor blade strip from direct contact with a body surface having hair to be trimmed.

6. The razor device as in claim 1, wherein the body cavity is selected from the group consisting of a nose cavity and an ear cavity.

7. The razor device as in claim 1, wherein the body cavity surface is selected from the group consisting of a skin surface and a tissue surface.

8. The razor shaving device as in claim 1 wherein:

the head structure includes first and second flexible razor blade strips, each formed from a strip of flat razor blade material and each having first and second ends and each having a first elongated longitudinal edge which is bent in a central section thereof to provide a razor-sharp curved section disposed between first and second straight sections substantially parallel to one another on either side thereof and terminating respectively at first and second ends, the straight sections each including a razor-sharp straight edge; and the handle connected to both the first and second ends of each of the razor blade strips;

the first and second razor blade strips each having a plurality of razor-sharp cutting regions spaced along at least the first longitudinal edge thereof, each cutting region having an exposed razor-sharp cutting edge for cutting hair strands coming in contact therewith;

the cutting regions of the first and second razor blade strips being aligned such that the first and second razor blade strips forms a plurality of cooperating cutting regions that are suitable for cutting hair strands that come in contact therewith upon movement of the device in a direction toward such hair strands.

9. The razor shaving device as in claim 8, wherein the head structure further comprises a guard member adjacent to the first and second razor blade strips when the first and second razor blade strips are brought together in an aligned relation, the guard member including a plurality of finger portions in part defining notches therebetween, with the notches being positioned in the vicinity of the cooperating cutting regions formed by alignment of the first and second razor blade strips, the notches of the guard member being sized to expose a substantial portion of the cooperating cutting regions for the trimming of hairs, and the finger portions being sized and positioned to prevent cuts to the body surface by the cutting regions.

10. The razor shaving device as in claim 9, wherein the guard member is disposed upon an outer one of the first and second razor blade strips when the first and second razor blade strips are brought together in an aligned relation.

11. The razor device as in claim 10, wherein the head structure further includes spacer means for keeping the first and second razor blade strips spaced from one another at a generally uniform distance.

12. The razor device as in claim 11, wherein the head structure further includes a platform member disposed adjacent to at least one of the razor blade strips, the guard member being arranged along the innermost blade strip as an extension of the platform member.

13. The razor device as in claim 8, further comprising a guard member having a plurality of spaced fingers operable for shielding the razor-sharp cutting regions of the first and second razor blade strips from direct contact with a body surface over which the device is moved.

14. The razor shaving device as in claim 8, wherein the first and second razor blade strips are laterally offset from one another, such that the longitudinal edges of the blade strips are also laterally offset from one another.

15. The razor device as in claim 1, further comprising a protective cover arranged to fit over the head structure when the device is in storage.

16. The razor device as in claim 15, wherein:

the head structure includes a base portion located near the first and second ends of the flexible razor blade strip, the base portion having a mating region for receiving a portion of the protective cover, and the protective cover has an opened portion at one end thereof that corresponds in shape to the mating region of the base portion of the head structure.

17. The razor device as in claim 15, wherein the protective cover is made of substantially transparent plastic material.

18. The razor device as in claim 1, wherein the handle is an elongated generally cylindrical structure having a central longitudinal axis that is generally parallel to the longitudinal edges of the first and second straight sections of the razor blade strip.

19. The razor device as in claim 1, wherein:

the handle includes a receiving surface, a beveled edge surface adjacent to the receiving surface, and a generally cylindrical surface adjacent to the beveled edge surface; and the first and second ends of the razor blade strip project into the receiving surface of the handle and are each supported in a fixed position spaced from the other end by the handle.

20. The razor device as in claim 1, wherein:

the head structure includes a base portion which captivates both the first and second ends of the flexible razor blade strip, thereby holding the ends in place, the base portion having at least one generally flat surface which is substantially perpendicular to the first and second straight sections of the razor blade strip.

21. The razor device as in claim 1, wherein only the first end of the razor blade strip is connected to the handle, whereby the handle supports the razor blade strip only from that end.

22. The razor device as in claim 1, wherein both the first and second ends of the razor blade strip are connected to and supported by the handle.

23. The razor device as in claim 22, wherein the head structure includes a base portion, and the first and second ends of the razor blade strip are connected to the base portion and supported by the handle through the base portion.

24. The razor device as in claim 23, wherein:

the base portion is initially separated from the handle, the base portion including a shaped outer region having at least one outwardly facing engagement surface, and the handle includes a cavity having shaped inner region provided with at least one inwardly facing engagement surface which is complementary to and interlockingly mates with the outwardly facing engagement surface when the base portion and the handle are connected together.

25. The razor device as in claim 24, wherein:

the handle is an elongated structure and has an upper region of predetermined outer appearance; and the base portion includes a second outer region that matches the predetermined outer appearance of the upper region of the handle, such that, when the base portion and the handle are connected together, the base portion both appears to be and serves as an extension of the handle.

26. The razor device as in claim 1, wherein:

the handle is a generally straight elongated structure having, over at least most of its length, a regular outer shape selected from the group consisting of a cylinder and a generally rectangular solid.

27. The razor device as in claim 1, wherein:

the base portion and the handle are each constructed to have complementary mating surfaces, such that the base portion and the handle are operative to be selectively coupled together at their complementary mating surfaces, the complementary mating surfaces also being arranged to permit the base portion to be selectively removed by a user of the device from the handle after being connected thereto, whereby, when the razor blade strip of the head structure becomes dull and spent with use, the user may remove the head structure including its base portion from the handle and replace it with a new, but otherwise identical, head structure having an unused razor blade strip.

28. The razor shaving device as in claim 1, wherein the razor blade strip further includes a plurality of razor-sharp cutting regions along a second longitudinal edge of the razor blade strip spaced from and opposite the first longitudinal edge, and wherein exposure of razor-sharp cutting edges along the first and second longitudinal edges of the razor blade strip allows the device to cut hairs upon movement of the device in a first direction and in a second direction distinctly different from the first direction.

29. The razor shaving device as in claim 1, wherein the head structure further comprises a blade support platform in contact with the razor blade strip at a plurality of locations.

30. The razor shaving device as in claim 1, wherein the head structure further comprises a cap member in contact with the razor blade strip at a plurality of locations.

31. The razor shaving device as in claim 1, wherein the razor blade strip has first and second opposed elongated surfaces and the head structure further comprises:

a flexible blade support platform disposed along the first elongated surface of the razor blade strip; and a flexible cap member disposed along the second elongated surface of the razor blade strip; and wherein a first edge portion of the blade support platform and a first edge portion of the cap member are operable to form front and rear guards suitable for allowing a razor-sharp edge of the razor blade strip positioned therebetween to safely trim hairs from a body surface.

32. The razor shaving device as in claim 1, wherein the head structure comprises a plurality of substantially identical flexible razor blade strips arranged in a spaced apart relation relative to one another.

33. The razor shaving device as in claim 1, wherein the razor blade strip includes a plurality of non-sharpened non-cutting regions formed along the first longitudinal edge thereof, each cutting region being located between a pair of non-cutting regions.

34. The razor shaving device as in claim 33, wherein the head structure further comprises a guard member disposed along the razor blade strip, the guard member having a plurality of finger portions in part defining notches therebetween, with the notches arranged in locations corresponding to the cutting regions of the longitudinal edge of the razor blade strip, the notches of the guard member being sized and positioned to expose the razor-sharp cutting edges of the cutting regions of the razor blade strip to allow those razor-sharp cutting edges to be used for trimming hairs which enter the notches, while the finger portions prevent the same razor-sharp cutting edges from contacting the body surface around those hairs being trimmed.

35. The razor shaving device as in claim 1, wherein the razor blade strip includes a second longitudinal edge opposite the first longitudinal edge, with both of the longitudinal edges being razor-sharp over at least the curved section thereof, such that the curved sections are each operable for cutting hairs which become located generally in front thereof by movement of the curved section of the device in a direction toward such hairs.

36. The razor device as in claim 35, wherein:

the head structure further comprises a guard member adjacent to the razor blade strip, the guard member including first and second sides respectively positioned near the first and second longitudinal edges, the first and second longitudinal edges of the razor blade strip are provided with razor sharp edge portions, the first and second sides of the guard member each have several finger portions defining in part therebetween several notches, with at least a majority of the notches each being located between two adjacent finger portions, and the notches on each respective side of the guard member are each sized to expose one of the razor-sharp edge portion of the adjacent longitudinal edge of the razor blade strip.

37. The razor device as in claim 36, wherein:

the guard member is mechanically fastened to the handle in a substantially rigid arrangement, the guard member has an inner surface and an outer surface, the razor blade strip is directly fastened to and abuts only one of the inner and outer surfaces of the guard member, and the razor blade strip is supported and carried by the guard member without directly touching any part of the handle, whereby the guard member provides a support structure for keeping the razor blade strip in place on the razor device.

* * * * *

UNITED STATES PATENT AND TRADEMARK OFFICE

CERTIFICATE OF CORRECTION

PATENT NO. : 5,983,499
DATED : November 16, 1999
INVENTOR(S) : Edward A. Andrews It is certified that error appears in the above-identified patent and that said Letters Patent is hereby corrected as shown below:

Column 7,
Line 4, replace "noise" with -- nose --.
Line 31, replace "an" with -- a --.
Line 37, after "shown" insert -- in --.

Column 8,
Line 30, replace "an" with -- a --.

Column 9,
Line 22, delete "when not in use".
Line 25, after "strip 44" insert -- when not in use --.

Column 10,
Line 2, replace "shape" with -- shaped --.

Column 11,
Line 9, after "version" insert -- 170A --.
Line 10, replace "170A" with -- 170 --.
Line 32, replace "interlocking" with -- interlock --.
Line 36, replace "170B" with -- 170 --.
Line 37, replace "170" with -- 170B --.
Line 37, replace "horseshoe-shaped a" with -- a horseshoe-shaped --.

Column 12,
Line 12, after "with" insert -- the --.

Column 13,
Line 40, replace "performed" with -- preformed --.

Column 17,
Line 31, delete "fingergrip" and insert -- engage the serrated blade strip --.

Column 20,
Line 45, after "hair" insert -- and ear hair --.
Line 52, after "and" insert -- between the pads of an animal's paw -- and delete "within animal paws".

Column 21,
Line 10, replace "a nose" with -- an effective safe --.

UNITED STATES PATENT AND TRADEMARK OFFICE

CERTIFICATE OF CORRECTION

PATENT NO. : 5,983,499
DATED : November 16, 1999
INVENTOR(S) : Edwards A. Andrews It is certified that error appears in the above-identified patent and that said Letters Patent is hereby corrected as shown below:

Column 21,
Line 11, before "." insert -- for use in body cavities or other close quarters --.

Claims,
Column 22, claim 5,
Line 4, replace "edge" with -- edges --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*